US009242761B2

(12) United States Patent
Iwata

(10) Patent No.: US 9,242,761 B2
(45) Date of Patent: Jan. 26, 2016

(54) BOX PALLET SIDE WALL

(75) Inventor: Takao Iwata, Mizuho (JP)

(73) Assignee: SANKO CO., LTD., Mizuho (JP)

( * ) Notice: Subject to any disclaimer, the term of this patent is extended or adjusted under 35 U.S.C. 154(b) by 228 days.

(21) Appl. No.: 14/006,393

(22) PCT Filed: Feb. 6, 2012

(86) PCT No.: PCT/JP2012/052638

§ 371 (c)(1),
(2), (4) Date: Sep. 20, 2013

(87) PCT Pub. No.: WO2012/140941

PCT Pub. Date: Oct. 18, 2012

(65) Prior Publication Data

US 2014/0008255 A1 Jan. 9, 2014

(30) Foreign Application Priority Data

Apr. 15, 2011 (JP) ..... 2011-091210

(51) Int. Cl.
*B65D 19/06* (2006.01)
*B65D 19/18* (2006.01)

(52) U.S. Cl.
CPC ..... *B65D 19/06* (2013.01); *B65D 19/18* (2013.01); *B65D 2519/009* (2013.01);
(Continued)

(58) Field of Classification Search
CPC ..... B65D 1/225; B65D 7/30; B65D 7/24; B65D 11/18; B65D 11/1873; B65D 11/1866; B65D 88/52; B65D 88/526; B65D 88/528
USPC ..... 206/386, 605; 220/7, 6, 4.28, 4.33
See application file for complete search history.

(56) References Cited

U.S. PATENT DOCUMENTS 3,857,342 A * 12/1974 Johns ..... B65D 19/0075 108/53.3
4,456,142 A 6/1984 Burling
(Continued)

FOREIGN PATENT DOCUMENTS

CN 1433368 A 7/2003
DE 35 00 427 A1 7/1986
(Continued)

OTHER PUBLICATIONS

Office Action issued in Chinese Application No. 201280018619.4 dated Oct. 27, 2014 (with translation).
(Continued)

*Primary Examiner* — Steven A. Reynolds
*Assistant Examiner* — King M Chu
(74) *Attorney, Agent, or Firm* — Oliff PLC

(57) ABSTRACT

To provide a box pallet side wall that is excellent in beauty and is easily cleaned as well compared to a conventional box pallet side wall, and in which weight saving and high strengthening is possible compared to the conventional one. This box pallet side wall forms a hollow structure having an enclosed space therein. Thus, compared to a conventional box pallet side wall having a solid structure, when the box pallet side wall and the conventional one have the same weight, the geometrical moment of inertia of the box pallet side wall is increased. Since cell configuration ribs for reinforcing an outer main plate and an inner main plate are housed in the box pallet side wall and not exposed outside, irregularity on an outer surface of the box pallet side wall can be decreased compared to the conventional one.

16 Claims, 38 Drawing Sheets

(52) U.S. Cl.
CPC ..... *B65D 2519/00034* (2013.01); *B65D 2519/00069* (2013.01); *B65D 2519/00174* (2013.01); *B65D 2519/00268* (2013.01); *B65D 2519/00288* (2013.01); *B65D 2519/00318* (2013.01); *B65D 2519/00333* (2013.01); *B65D 2519/00502* (2013.01); *B65D 2519/00517* (2013.01); *B65D 2519/00527* (2013.01); *B65D 2519/00587* (2013.01); *B65D 2519/00611* (2013.01); *B65D 2519/00646* (2013.01); *B65D 2519/00791* (2013.01); *B65D 2519/00975* (2013.01)

(56) References Cited

U.S. PATENT DOCUMENTS

| | | | | | |
|---|---|---|---|---|---|
| 5,160,029 | A * | 11/1992 | Pigott | B65D 71/0096 | 206/386 |
| 5,168,621 | A | 12/1992 | Kruck et al. | | |
| 5,384,173 | A * | 1/1995 | Akao | G03C 3/00 | 220/669 |
| 5,460,292 | A * | 10/1995 | Holman | B65D 19/04 | 206/512 |
| 6,021,916 | A * | 2/2000 | Stolzman | B65D 19/18 | 206/600 |
| 6,161,715 | A * | 12/2000 | Stolzman | B65D 19/18 | 220/1.5 |
| 2003/0102309 | A1 * | 6/2003 | Hartwall | B65D 19/18 | 220/6 |
| 2004/0238400 | A1 * | 12/2004 | Knutsson | B65D 11/1833 | 206/600 |
| 2007/0110944 | A1 * | 5/2007 | Grandominico | B29C 65/08 | 428/57 |
| 2008/0169285 | A1 * | 7/2008 | Marazita | B65D 19/18 | 220/7 |
| 2009/0152151 | A1 * | 6/2009 | Schubbach | C08L 23/0807 | 206/386 |
| 2011/0259248 | A1 * | 10/2011 | Grgac | B65D 19/0016 | 108/57.33 |
| 2014/0008255 | A1 * | 1/2014 | Iwata | B65D 19/06 | 206/386 |

FOREIGN PATENT DOCUMENTS

| | | | |
|---|---|---|---|
| DE | 20 2010 000 856 | U1 | 5/2010 |
| JP | A-4-69230 | | 3/1992 |
| JP | A-4-327170 | | 11/1992 |
| JP | U-3084649 | | 3/2002 |
| JP | A-2010-105731 | | 5/2010 |
| WO | WO 01/47780 | A1 | 7/2001 |
| WO | WO 2005/100176 | A2 | 10/2005 |

OTHER PUBLICATIONS

Office Action issued in Japanese Patent Application No. 2011-091210 dated Jun. 4, 2014 (with translation).
International Search Report issued in International Patent Application No. PCT/JP2012/052638 dated May 15, 2012 (with translation).
Written Opinion issued in International Patent Application No. PCT/JP2012/052638 dated May 15, 2012 (with translation).
Supplementary Search Report issued in European Patent Application No. 12 77 1741 dated Sep. 16, 2014.

* cited by examiner

BOX PALLET SIDE WALL

TECHNICAL FIELD

The present invention relates to a box pallet side wall to be assembled on a pallet main body to construct a box pallet.

BACKGROUND ART

Conventionally, this type of box pallet side wall has a structure in which reinforcing ribs are provided on the entire outer surface of a main plate portion (refer to, for example, Patent Document 1).

PRIOR ART DOCUMENT

Patent Document

Patent Document 1: Japanese Unexamined Patent Application Publication No. H04-327170 (FIG. 1)

SUMMARY OF THE INVENTION

Problems to be Solved by the Invention

However, the conventional box pallet side wall mentioned above has a problem that the outer surface shape is complicated because of the reinforcing ribs and thus spoils the appearance and makes cleaning difficult. Moreover, since before it has been demanded for a box pallet to be lighter in weight as long as it has the same strength and to have a higher strength as long as it has the same weight.

The present invention has been made in view of the above-mentioned circumstances, and an object thereof is to provide a box pallet side wall that is excellent in the appearance and is easily cleaned as well compared with a conventional box pallet side wall, and in which weight saving and high strengthening is possible compared with a conventional one.

Means for Solving the Problems

A box pallet side wall according to an invention of claim 1 made in order to achieve the above-mentioned object is a box pallet side wall that is assembled in plural numbers on an upper surface edge portion of a pallet main body, and constructs together with the pallet main body a box pallet with a box-shaped structure opened at an upper surface, and is characterized by an outer main plate and an inner main plate forming a hollow structure having an enclosed space therein, and being opposed in a thickness direction of the box pallet side wall across the enclosed space, a cell configuration rib for joining the outer main plate and the inner main plate, and demarcating the enclosed space into a plurality of cells, and a fixed layer disposed at a position dividing the entire box pallet side wall into two parts in the thickness direction, and formed by firmly fixing resins constructing the box pallet side wall to each other.

An invention of claim 2 is the box pallet side wall according to claim 1, characterized by a plurality of central region cells included in the plurality of cells, and disposed in a central region that is inner than an outer edge portion of the box pallet side wall, and a plurality of upper edge region cells included in the plurality of cells, disposed in an upper edge region along an upper outer edge portion in the box pallet side wall, and demarcated more finely than the plurality of central region cells.

An invention of claim 3 is the box pallet side wall according to claim 1 or 2, characterized by a plurality of central region cells included in the plurality of cells, and disposed in a central region that is inner than an outer edge portion of the box pallet side wall, and a plurality of side edge region cells included in the plurality of cells, disposed in a side edge region along an outer edge portion at both left and right sides in the box pallet side wall, and demarcated more finely than the plurality of central region cells.

An invention of claim 4 is the box pallet side wall according to claim 1, characterized by a plurality of central region cells included in the plurality of cells, and disposed in a central region that is inner than an outer edge portion of the box pallet side wall, and a plurality of frame-like region cells included in the plurality of cells, disposed in a frame-like region of an entire outer edge portion of the box pallet side wall, and demarcated more finely than the plurality of central region cells.

An invention of claim 5 is the box pallet side wall according to any one of claims 1 to 4, characterized by a lower surface groove formed in a lower surface of the box pallet side wall, having a groove shape extending along the fixed layer, and having the fixed layer at a bottom surface of the groove shape.

An invention of claim 6 is the box pallet side wall according to claim 5, characterized by a reinforcing protrusion formed at the bottom surface of the lower surface groove, and extending from a groove inner side surface of the lower surface groove to a position approximating the fixed layer.

An invention of claim 7 is the box pallet side wall according to any one of claims 1 to 6 characterized in that parts outer and inner than the fixed layer are differentiated in color.

An invention of claim 8 is the box pallet side wall according to claim 7, characterized in that, among a plurality of the box pallet side walls to be assembled on the pallet main body in common, colors of parts outer than the fixed layer are same colors or same type of colors, or colors of parts inner than the fixed layer are same colors or same type of colors.

Advantageous Effects of Invention

[Invention of Claim 1]

The box pallet side wall of claim 1 includes an outer main plate and an inner main plate forming a hollow structure and being opposed to each other, so that compared to a conventional box pallet side wall having a solid structure, when the box pallet side wall and the conventional one have the same weight, the geometrical moment of inertia of the box pallet side wall is increased and the strength thereof is higher than that of the conventional one, and when the box pallet side wall and the conventional one have the same strength, the box pallet side wall is lighter in weight than the conventional one. Moreover, because the interior of the box pallet side wall of the present invention is an enclosed space, the box pallet side wall also never becomes heavier in weight due to entry of water. Further, because both of the outer main plate and inner main plate are reinforced by the cell configuration rib that demarcates the enclosed space into a plurality of cells, high strengthening and weight saving become possible also in this point compared to the conventional one. Moreover, since the cell configuration ribs that reinforce the outer main plate and inner main plate are housed in the box pallet side wall and not exposed on the outside, irregularity on the outer surface of the box pallet side wall can be decreased compared to the conventional one, cleaning is easily performed, and the appearance is improved.

Also, because the box pallet side wall of the present invention includes a layer of resins firmly fixed to each other at a position dividing the entire box pallet side wall into two parts in the thickness direction, a box pallet side wall can be manufactured by separately preparing a resin molding that constructs a part outer than the fixed layer of the box pallet side wall and a resin molding that constructs an inner part by injection molding in advance, and joining and firmly fixing those resin moldings to each other. The fixation method therefor may be any, and an example of the fixation method that can be provided is vibration welding, heat welding, or firmly fixing by an adhesive.

[Invention of Claim 2]

When a forklift fork is inserted into an upper box pallet of a plurality of stacked box pallets, the fork may erroneously abut against an upper edge region of the box pallet side wall in the lower box pallet. On the other hand, in the invention of claim 2, because reinforcement is provided as a result of a plurality of upper edge region cells disposed in an upper edge region of the box pallet side wall being demarcated more finely than a plurality of central region cells disposed in a central region, damage and deformation of the box pallet side wall due to abutting of the fork are prevented. Moreover, as compared to one in that the cells are made fine in the whole of the box pallet side wall to achieve reinforcement, an increase in weight of the box pallet side wall can be suppressed.

[Invention of Claim 3]

When a forklift fork is inserted into a pallet main body in a state of a box pallet side wall being laid and placed on an upper surface of the pallet main body, the fork may erroneously abut against a side edge region of the box pallet side wall. On the other hand, in the state of claim 3, because reinforcement is provided as a result of a plurality of side edge region cells disposed in a side edge region of the box pallet side wall being demarcated more finely than a plurality of central region cells disposed in a central region, damage and deformation of the box pallet side wall due to abutting of the fork are prevented. Moreover, as compared to one in that the cells are made fine in the whole of the box pallet side wall to achieve reinforcement, an increase in weight of the box pallet side wall can be suppressed.

[Invention of Claim 4]

In the configuration of claim 4, because reinforcement is provided as a result of a plurality of frame-like region cells disposed in a frame-like region in an outer edge region of the box pallet side wall that is likely to receive a relatively large load being demarcated more finely than a plurality of central region cells disposed in a central region, damage and deformation of the box pallet side wall due to abutting of the fork are prevented. Moreover, as compared to one in that the cells are made fine in the whole of the box pallet side wall to achieve reinforcement, an increase in weight of the box pallet side wall can be suppressed.

[Invention of Claim 5]

At a part where the fixed layer is exposed in the box pallet side wall, an excess resin and excess adhesive can be cured and form a protrusion. On the other hand, in the box pallet side wall of claim 5, a lower surface groove is provided in a lower surface, the fixed layer is disposed on its bottom surface, so that a protrusion of an excess resin and excess adhesive is housed within the lower surface groove, and protected from coming into contact with the pallet main body, a floor surface, etc. Accordingly, such a situation can be prevented that the fixed layer cracks due to a stress concentration caused by a load on the protrusion of the excess resin and excess adhesive.

[Invention of Claim 6]

In the box pallet side wall of claim 6, because a reinforcing protrusion extends from a groove inner side surface of the lower surface groove to a position approximating the fixed layer, such a situation can be prevented that an upper surface corner portion of the pallet main body projects into the inside of the lower surface groove and comes into contact with the protrusion of the excess resin and excess adhesive.

[Invention of Claim 7]

In the box pallet side wall of claim 7, because parts outer and inner than the fixed layer are differentiated in color, the inner surface and outer surface of a box pallet can be easily distinguished based on the colors, and the efficiency of assembling work of the box pallet onto the pallet main body is improved.

[Invention of Claim 8]

In the configuration of claim 8, among a plurality of the box pallet side walls to be assembled on the pallet main body in common, colors of parts outer than the fixed layer are same colors or same type of colors, colors of parts inner than the fixed layer are same colors or same type of colors. Therefore, a plurality of box pallets can be efficiently assembled on the pallet main body in a manner of matching the colors among the box pallets.

MODES FOR CARRYING OUT THE INVENTION

Figure 1:
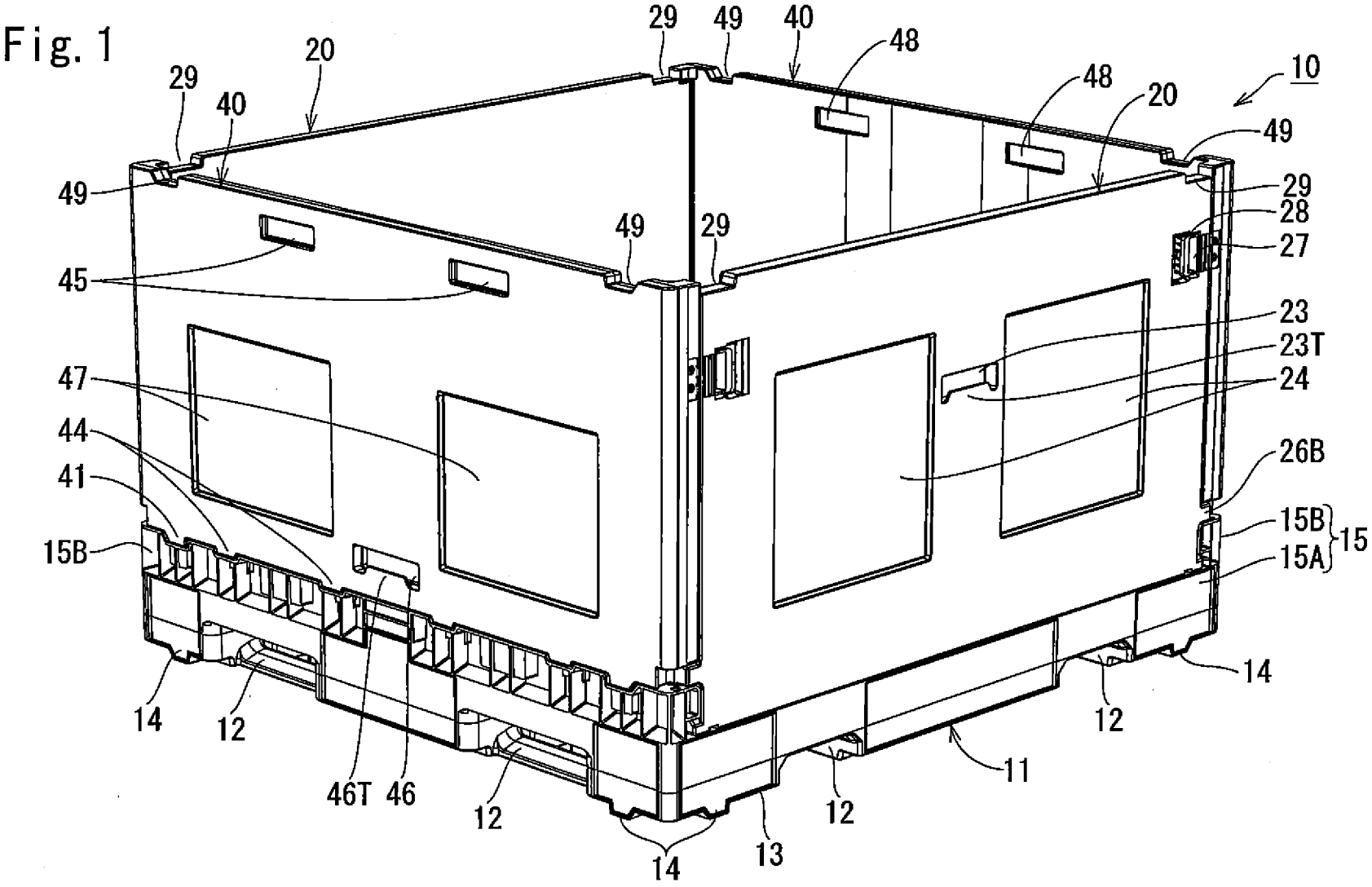
FIG. 1 is a perspective view of a box pallet according to an embodiment of the present invention.

Hereinafter, an embodiment of the present invention will be described based on FIG. 1 to FIG. 30. As shown in FIG. 1, a box pallet 10 of the present embodiment is formed by assembling a pair of first pallet side walls 20, 20 and a pair of second pallet side walls 40, 40 on a pallet main body 11. The pallet main body 11 has a substantially rectangular parallelepiped shape that is flattened in the up-down direction, and is provided with a pair of fork insertion holes 12 in a penetrated state in both longitudinal and transverse directions for insertion of a forklift fork.

A lower surface of the pallet main body 11 is shifted upward in a stepped manner at an outer edge portion to form a stacking contact portion 13. Moreover, in respective corner portions of the stacking contact portion 13, at two positions across the vertices of those respective corner portions, a pair of trapezoidal lower surface positioning projection portions 14, 14 are formed in a projecting manner.

Figure 2:
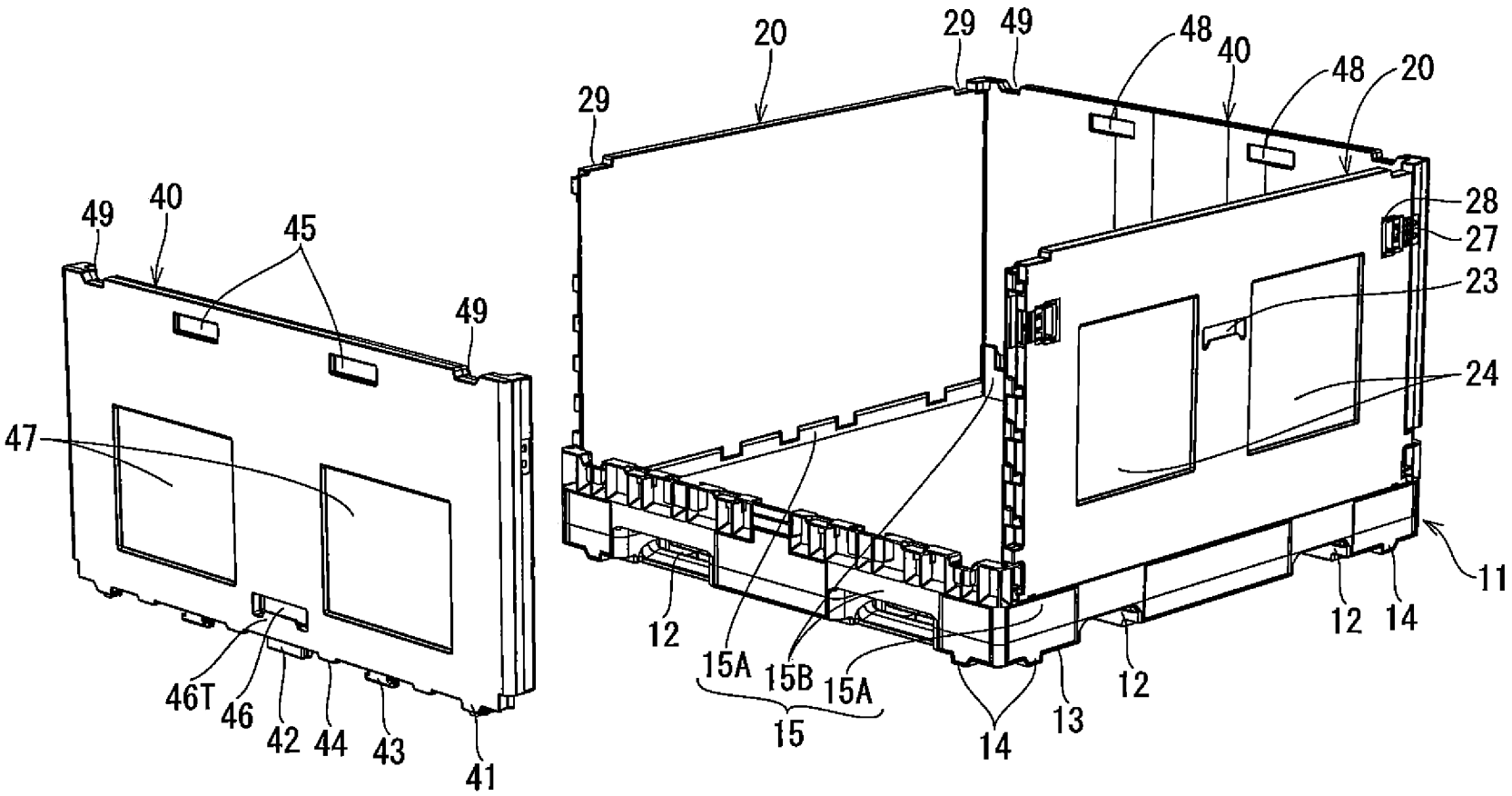
FIG. 2 is a perspective view of the box pallet with one of second pallet side walls removed.

As shown in FIG. 2, a side wall support portion 15 projects from an outer edge portion of an upper surface of the pallet main body 11. A pair of turn support portions 15A, 15A disposed on a pair of opposing sides of the side wall support portion 15 are higher than the upper surface of the pallet main body 11 by the thickness of one first pallet side wall 20, and a pair of insertion support portions 15B, 15B located on the other pair of opposing sides are higher than the turn support portion 15A by the thickness of one each of the first pallet side walls 20 and the second pallet side walls 40 overlaid. The pair of first pallet side walls 20, 20 are turnably assembled on the pair of turn support portions 15A, 15A, and the pair of second pallet side walls 40, 40 are non-turnably assembled on the pair of insertion support portions 15B, 15B.

In the present embodiment, the first pallet side wall 20 and the second pallet side wall 40 correspond to the "box pallet side wall" of the present invention, and both have hollow structures. In the following, first, detailed structures other than the internal structure will be described in detail for the first pallet side wall 20, then detailed structures other than the internal structure will be described in detail for the second pallet side wall 40, and then the internal structures of the first pallet side wall 20 and the second pallet side wall 40 will be described in detail.

Also, unless otherwise specified in the following description, the "outer surface of the first pallet side wall 20" does not mean an exterior surface with respect to an interior surface of the hollow structure of the first pallet side wall 20, but means a surface outside a content housing space surrounded by the first pallet side walls 20 and the second pallet side walls 40 of the box pallet 10. Moreover, the "inner surface of the first pallet side wall 20" does not mean an interior surface of the hollow structure of the first pallet side wall 20, but means an inside surface facing the content housing space surrounded by the first pallet side walls 20 and the second pallet side walls 40 of the box pallet 10. The same applies to the second pallet side wall 40.

Figure 3:
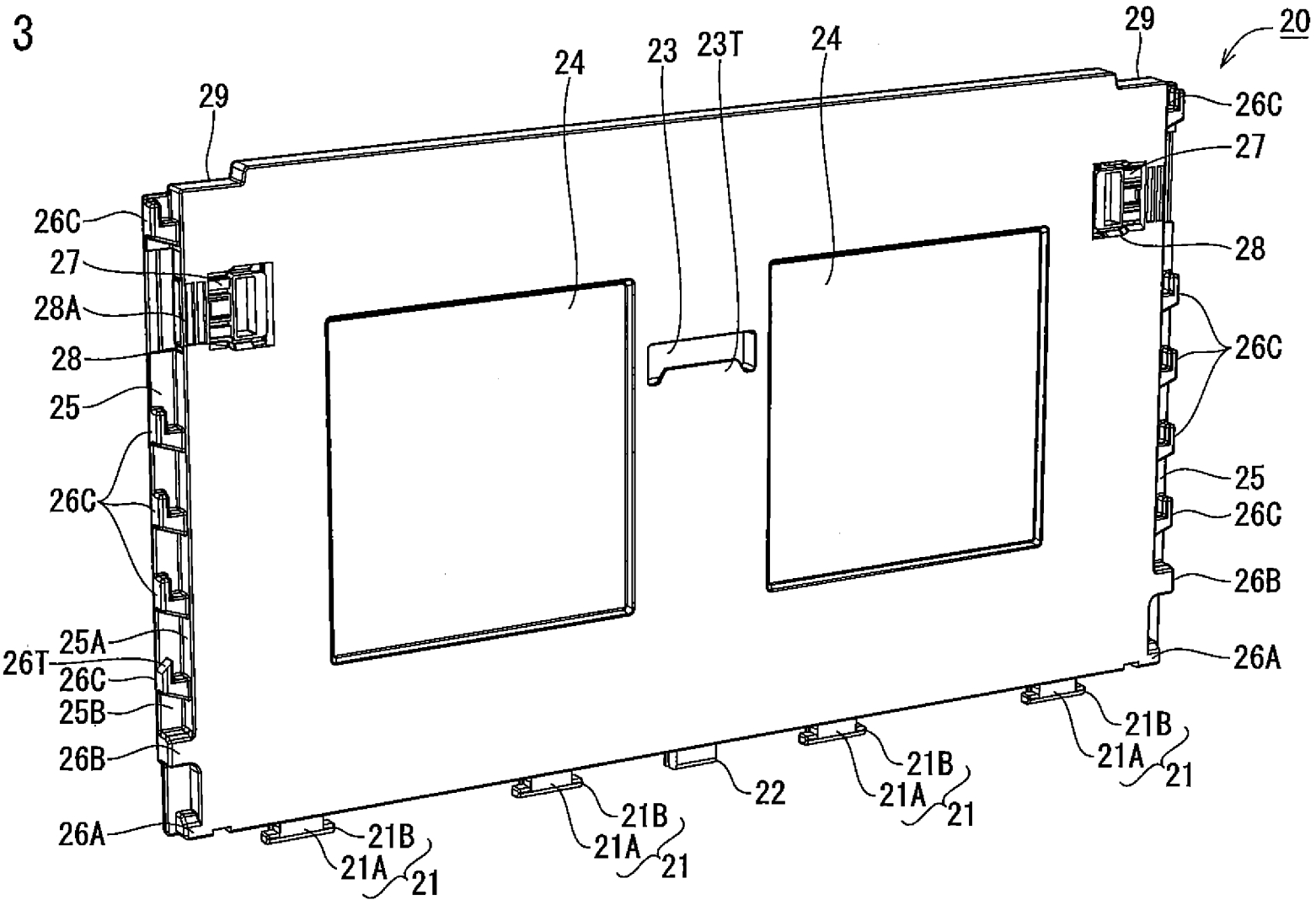
FIG. 3 is a perspective view of a first pallet side wall.
Figure 4:
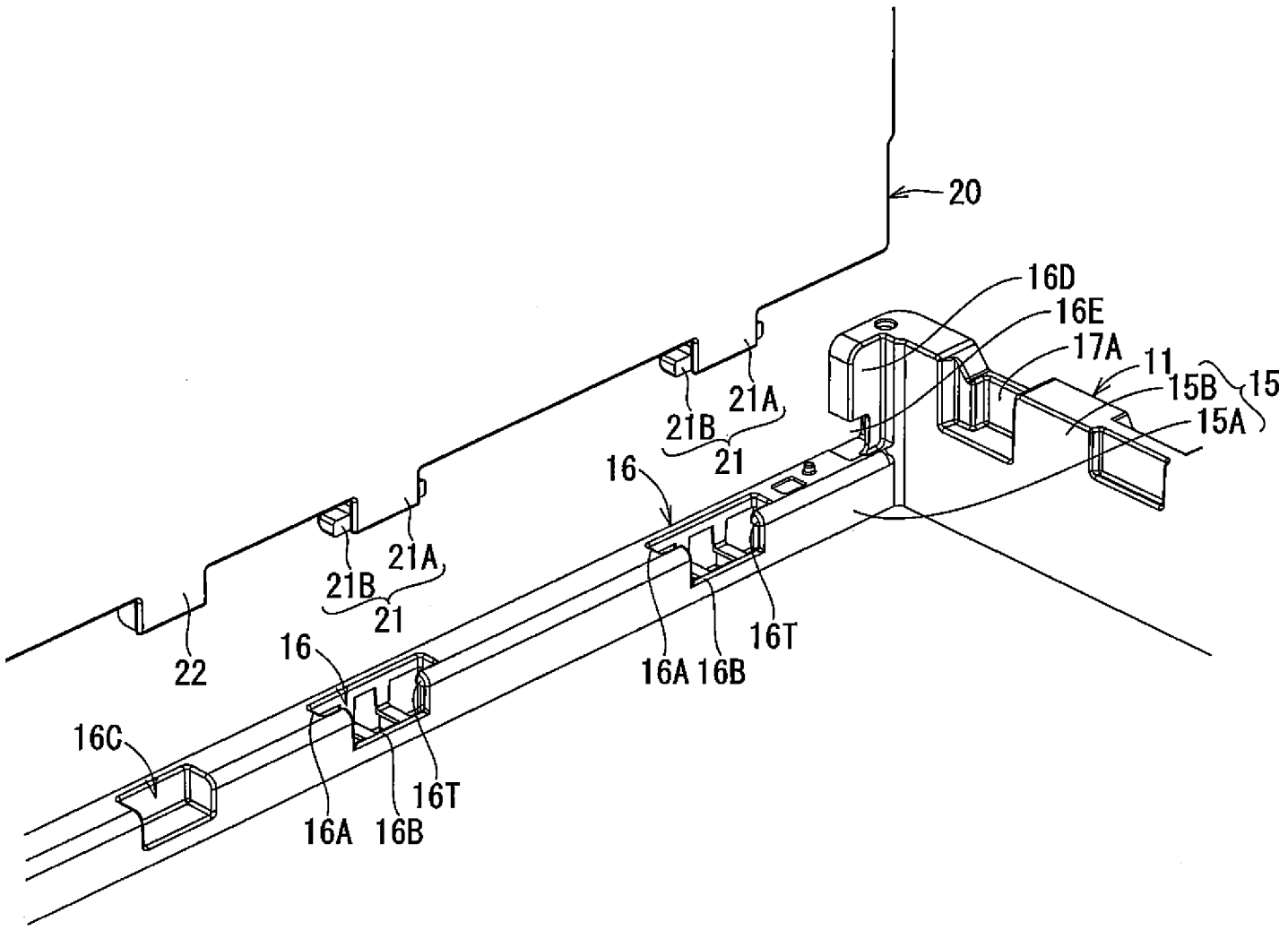
FIG. 4 is a perspective view of a lower end portion of the first pallet side wall and a turn support portion.

As shown in FIG. 3, the first pallet side wall 20 is in a rectangular shape that is transversally long in its entirety, and is provided at a lower surface with a plurality of hinge projection portions 21. The plurality of hinge projection portions 21 include turning shaft portions 21B at tip ends of projecting base portions 21A projecting downward from the lower surface of the first pallet side wall 20. As shown in FIG. 4, the projecting base portion 21A is wide in width in the longitudinal direction of the lower surface of the first pallet side wall 20, and both end portions of the turning shaft portion 21B project bilaterally from both side surfaces in the wide width direction of the projecting base portion 21A.

Also, the turning shaft portion 21B is flattened in the up-down direction, and a surface of the turning shaft portion 21B, facing the outside in the thickness direction of the first pallet side wall 20 is curved, and a surface opposite thereto and both upper and lower surfaces are flat faces.

In response to the plurality of hinge projection portions 21 of the first pallet side wall 20, in the turn support portion 15A of the pallet main body 11, a plurality of turn support recess portions 16 are formed by depression. The turn support recess portions 16 are open in an upper surface and inner side surface of the turn support portion 15A. The upper surface opening 16A of the turn support recess portion 16 has substantially the same size as that of a planar shape of the hinge projection portion 21, and the side surface opening 16B of the turn support recess portion 16 has substantially the same width as that of the projecting base portion 21A in the hinge projection portion 21. Moreover, in an upper end portion of a side surface in the turn support recess portion 16, retaining projections 16T, 16T are provided on both sides of the side surface opening 16B of the turn support recess portion 16 (in FIG. 4, only one retaining projection 16T is shown).

Figure 5:
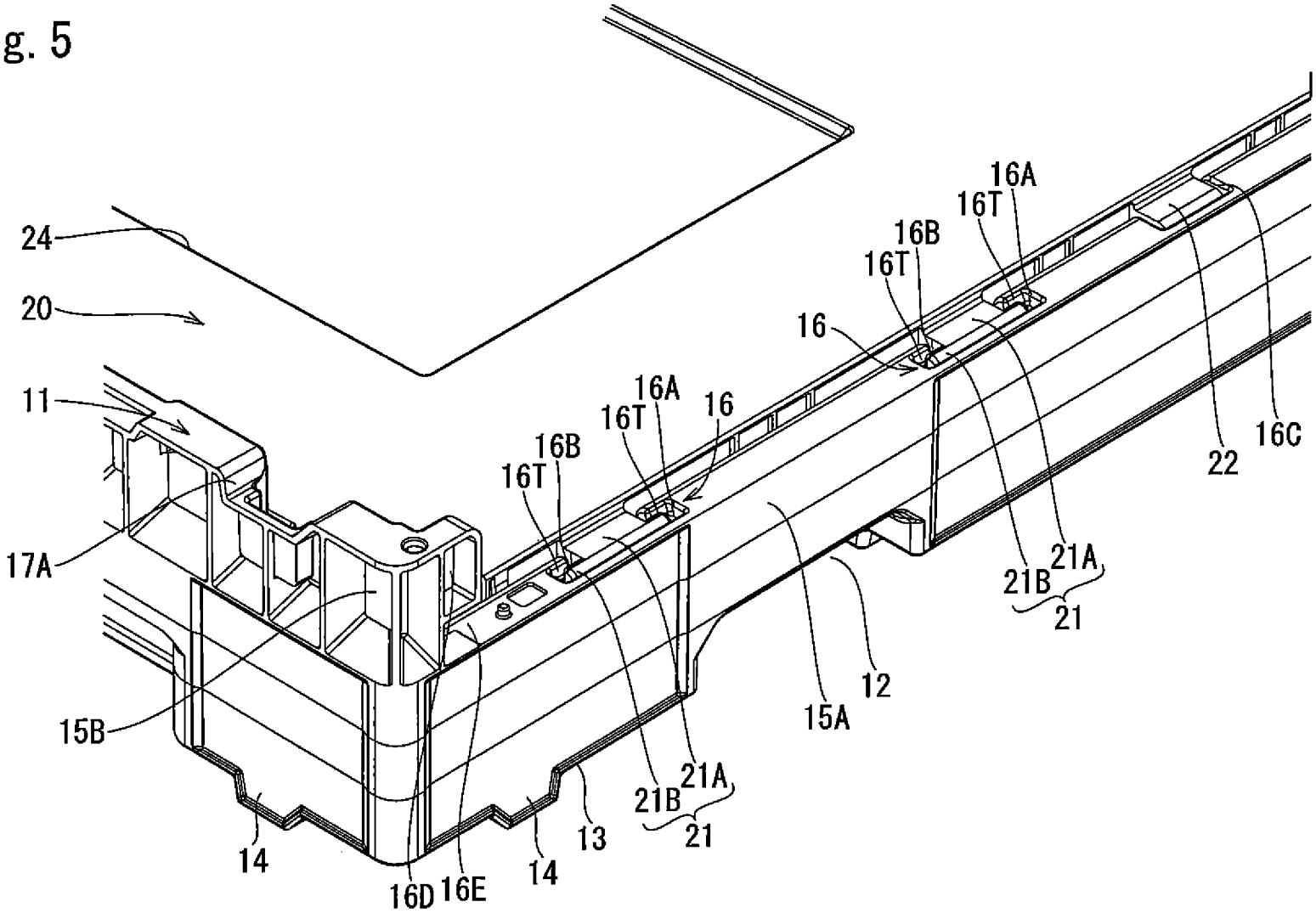
FIG. 5 is a perspective view of a state where the lower end portion of the first pallet side wall is assembled on the turn support portion.

As shown in FIG. 5, the first pallet side wall 20 is, in a horizontally laid state, inserted at the turning shaft portion 21B between the retaining projections 16T, 16T and an inner side surface opposing to those. Then, when the first pallet side wall 20 is turned upward about the turning shaft portion 21B serving as a support point to be erected on the turn support portion 15A (refer to FIG. 2), the turning shaft portion 21B slides under the retaining projections 16T (refer to FIG. 7), and the hinge projection portion 21 reaches a state of being retained with respect to the turn support recess portion 16. Thus, the first pallet side wall 20 is turnably joined to the turn support portion 15A.

As shown in FIG. 3, at a longitudinal center of the lower surface of the first pallet side wall 20, a central projection portion 22 is provided. As shown in FIG. 4, the central projection portion 22 is in a shape of the hinge projection portion 21 mentioned above excluding the turning shaft portion 21B. Moreover, in response to this central projection portion 22, a central recess portion 16C is formed in the turn support portion 15A of the pallet main body 11. The central recess portion 16C is open with the same width as that of the central projection portion 22 in the upper surface and inner side surface of the turn support portion 15A. And, the central projection portion 22 is received within the central recess portion 16C and restricts a transverse movement of the first pallet side wall 20.

Figure 6:
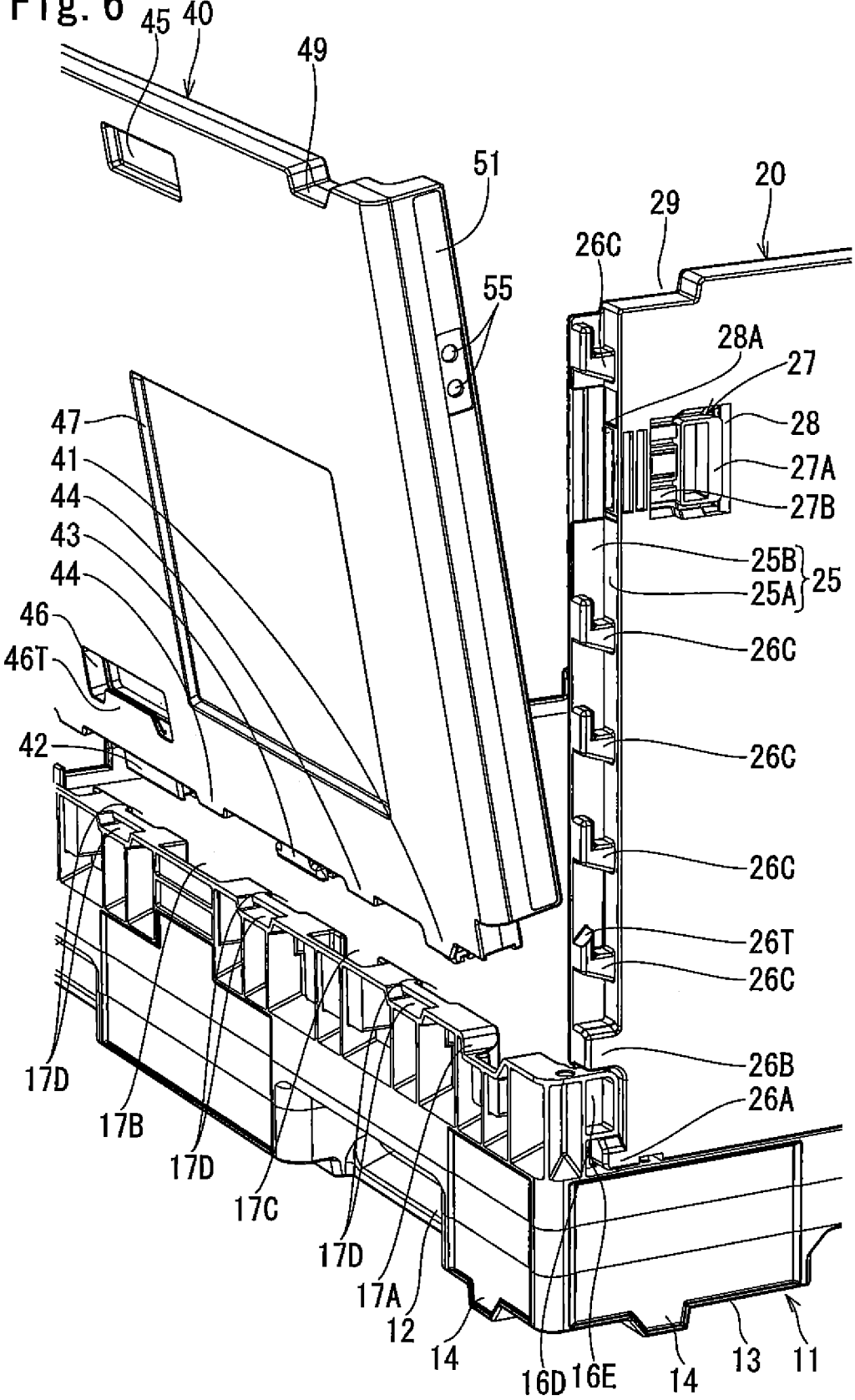
FIG. 6 is a perspective view of a state where a second pallet side wall is inclined above an insertion support portion.

As shown in FIG. 4, above both end portions of the turn support portion 15A, turn restricting projecting walls 16D project from the insertion support portions 15B (in FIG. 4, only one turn restricting projecting wall 16D is shown). Moreover, a lower end portion of the turn restricting projecting wall 16D is depressed in a stepped manner to the insertion support portion 15B side to serve as a lock recess portion 16E. And, when the first pallet side wall 20 is brought into an erected position, as shown in FIG. 6, lower portions of both side edge portions of the first pallet side wall 20 come into contact with the turn restricting projecting walls 16D and outward tilting of the first pallet side wall 20 is restricted.

As shown in FIG. 3, on an outer surface of the first pallet side wall 20, a handhold portion 23 is formed by depression at the center in an upper edge portion. The handhold portion 23 has a transversally long rectangular shape, and is in a shape including a projection piece 23T at its lower end opening edge. The projection piece 23T is flush with the outer surface of the first pallet side wall 20 and projects inside an opening of the handhold portion 23.

On both sides of the handhold portion 23 on the outer surface of the first pallet side wall 20, outer surface depression portions 24, 24 are provided in which the outer surface of the first pallet side wall 20 is depressed slightly. The outer surface depression portion 24 is in a quadrilateral shape, and is formed in a range extending from a position close to the top of the first pallet side wall 20 to a position close to the bottom in the up-down direction, and in the left-right direction, extending from the center of the first pallet side wall 20 to a position close to a side portion.

In the first pallet side wall 20, both side edge portions of the outer surface are depressed at a fixed width to form lateral side stepped recess portions 25, 25. In a lower end portion in each lateral side stepped recess portion 25, a first side surface projection portion 26A is provided, and thereabove a second side surface projection portion 26B is provided. The first side surface projection portion 26A has a structure in which a tapered surface is provided at an upper corner portion of a rectangular parallelepiped integrated with a stepped surface 25A and an innermost surface 25B of the lateral side stepped recess portion 25. Moreover, the second side surface projection portion 26B is in a rectangular parallelepiped shape that is integrated with the stepped surface 25A and the innermost surface 25B of the lateral side stepped recess portion 25. And, when the first pallet side wall 20 is brought into the erected position, it reaches a state in which, as shown in FIG. 6, the first side surface projection portion 26A is fitted and engaged with the lock recess portion 16E with its tapered surface made into sliding contact with a lower portion of a turn restricting projecting wall 16D, and the first side surface projection portion 26A and the second side surface projection portion 26B sandwich the turn restricting projecting wall 16D in the up-down direction whereby an up-and-down movement of the first pallet side wall 20 with respect to the pallet main body 11 is restricted.

As shown in FIG. 6, above the second side surface projection portion 26B in the lateral side stepped recess portion 25, a plurality of upward engaging hooks 26C are provided aligned in the up-down direction. Each upward engaging hook 26C is integrally continuous with the stepped surface 25A and the innermost surface 25B of the lateral side stepped recess portion 25 projects laterally from the stepped surface 25A, and has its tip end portion in a shape bent upward. Moreover, only the upward engaging hook 26C at the lowermost end is formed with a guiding tapered surface 26T. The guiding tapered surface 26T is formed by cutting an upper end portion of the upward engaging hook 26C obliquely (at, for example, 45 degrees) with respect to the up-down direction, and is inclined so as to separate from the stepped surface 25A toward the downside.

The topmost upward engaging hook 26C is disposed in an upper end portion of the lateral side stepped recess portion 25, and the interval between the topmost upward engaging hook 26C and the second topmost upward engaging hook 26C is larger than the interval between other neighboring upward engaging hooks 26C. And, in the stepped surface 25A between the topmost and its following upward engaging hooks 26C, 26C, a stepped surface opening 28A is provided so that the tip end of a coupling slider 27 projects and retracts from the stepped surface opening 28A.

Figure 9A:
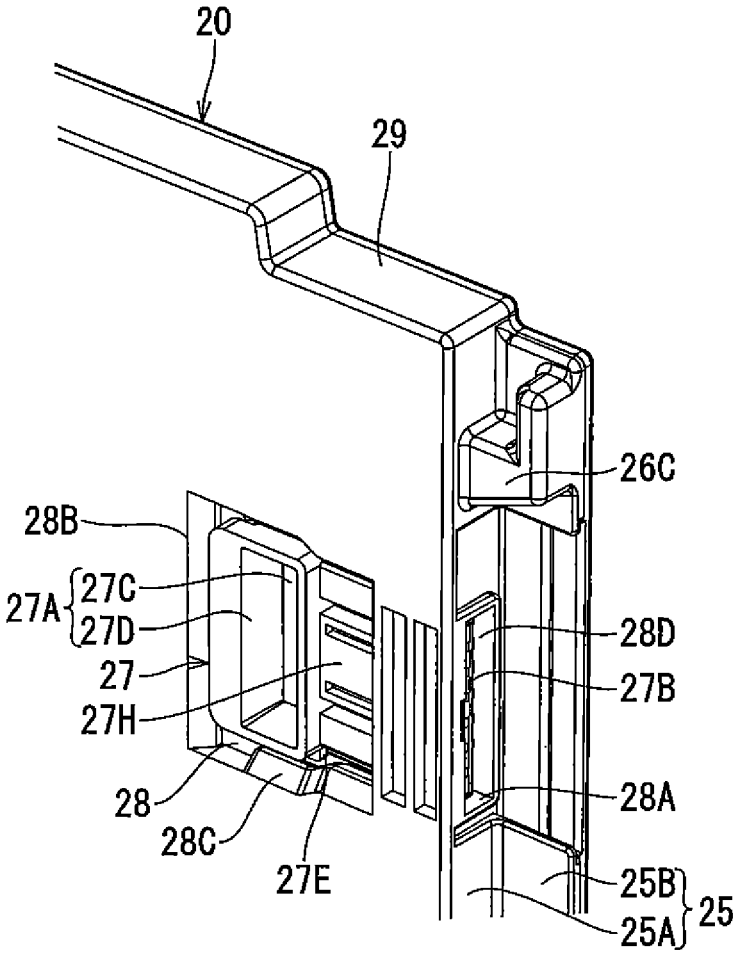
FIG. 9A is a perspective view of a coupling slider disposed at one end side of a slider receiving portion.
Figure 9B:
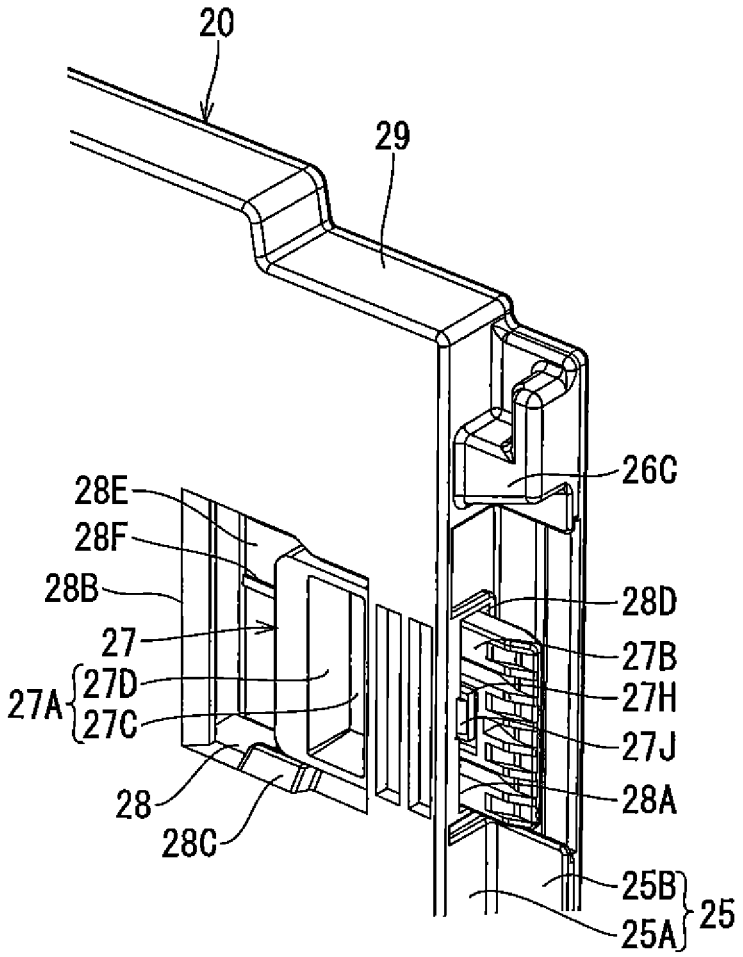
FIG. 9B is a perspective view of the coupling slider disposed at the other end side of the slider receiving portion.

Specifically, as shown in FIG. 3, at positions close to both corner portions in an upper portion of the first pallet side wall 20, slider receiving portions 28 are formed by depression. Each slider receiving portion 28, as shown in FIG. 9A, has a substantially quadrilateral outer surface opening 28B in the outer surface of the first pallet side wall 20, and includes a guide hole 28D communicated with the stepped surface 25A of the lateral side stepped recess portion 25, and an end portion of the guide hole 28D is opened at the stepped surface 25A to serve as the stepped surface opening 28A. Moreover, from upper and lower opening edges of the outer surface opening 28B, sliding lock pieces 28C are projected inward (in FIG. 9A, only one sliding lock piece 28C is shown). Further, as shown in FIG. 9B, at an innermost surface 28E of the slider receiving portion 28, a guide protrusion 28F extending in the horizontal direction is provided.

Figure 10A:
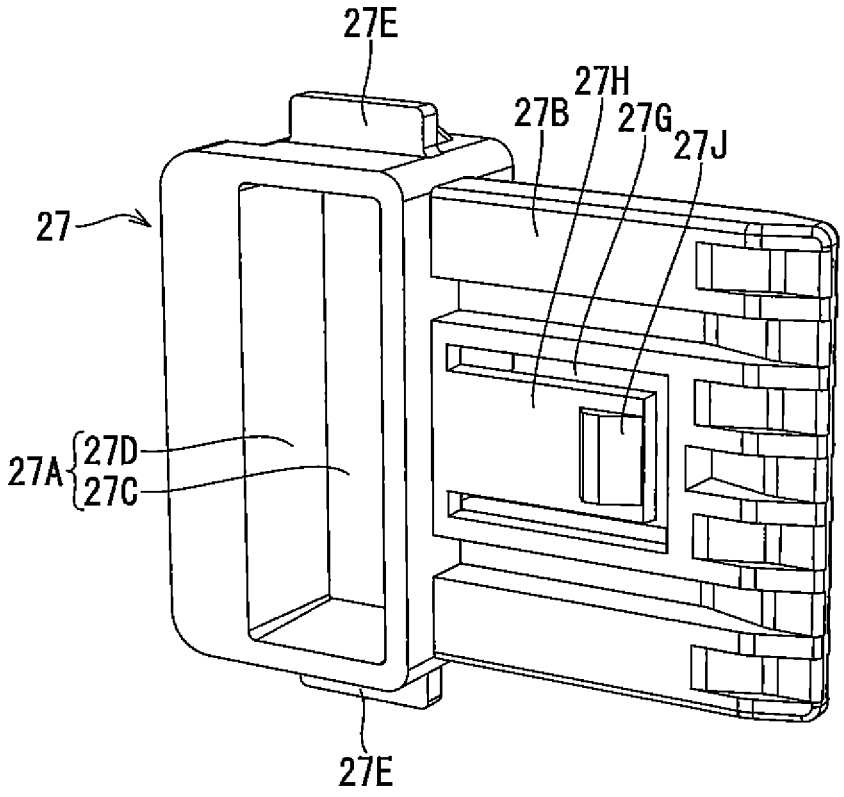
FIG. 10A is a perspective view of a front side of the coupling slider.

The coupling slider 27, as shown in FIG. 10A, includes a box-shaped operating portion 27A having a structure in which a longitudinally long rectangular plate 27C is surrounded by a rectangular cylindrical wall 27D. And, as shown in FIG. 9B, the coupling slider 27 is received in the slider receiving portion 28 with the rectangular plate 27C of the box-shaped operating portion 27A and the innermost surface 28E of the slider receiving portion 28 opposed to each other.

Figure 22:
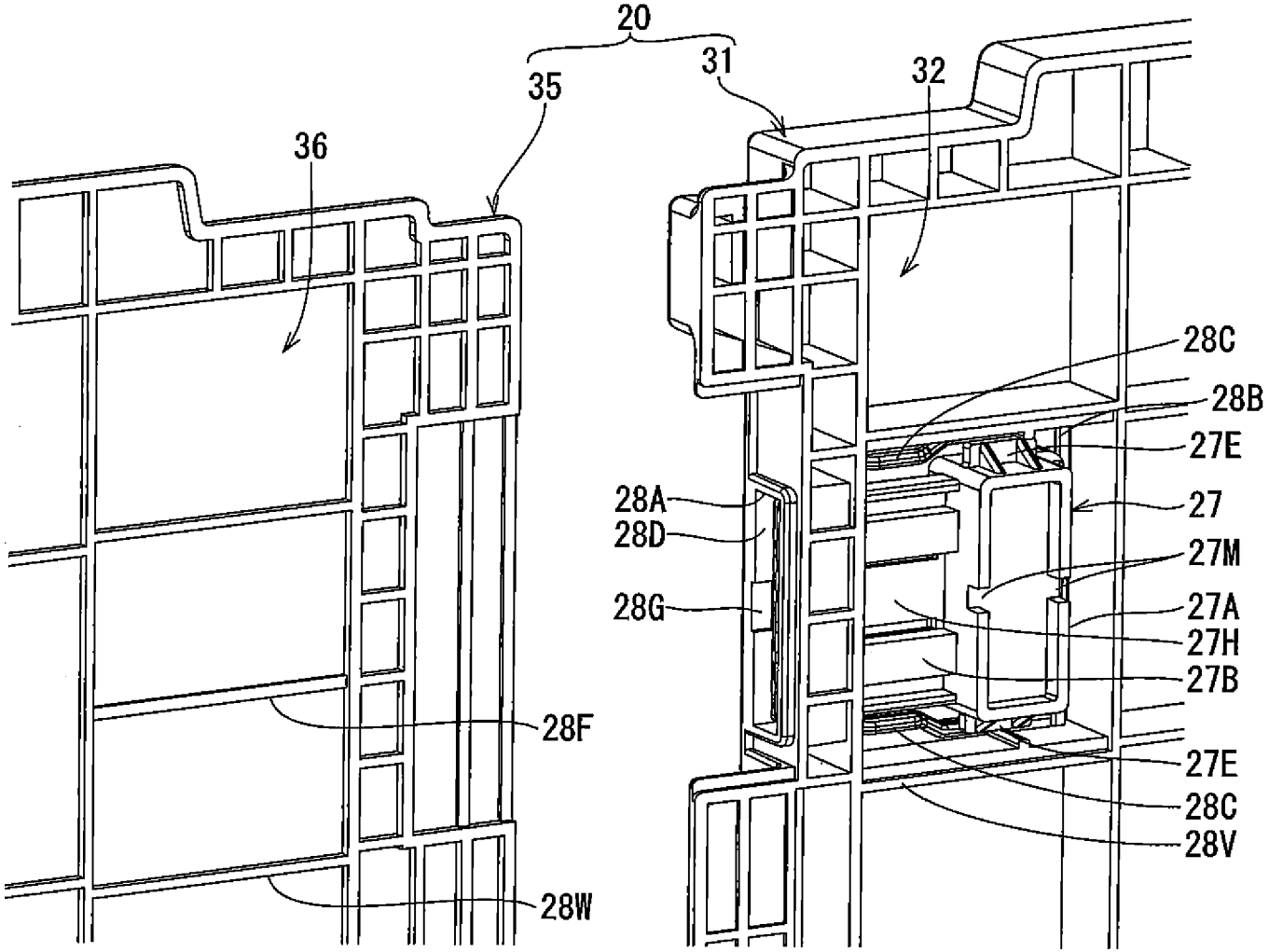
FIG. 22 is a perspective view of an inner surface side of upper end corner portions of the outer configuration panel and inner configuration panel of the first pallet side wall.
Figure 23:
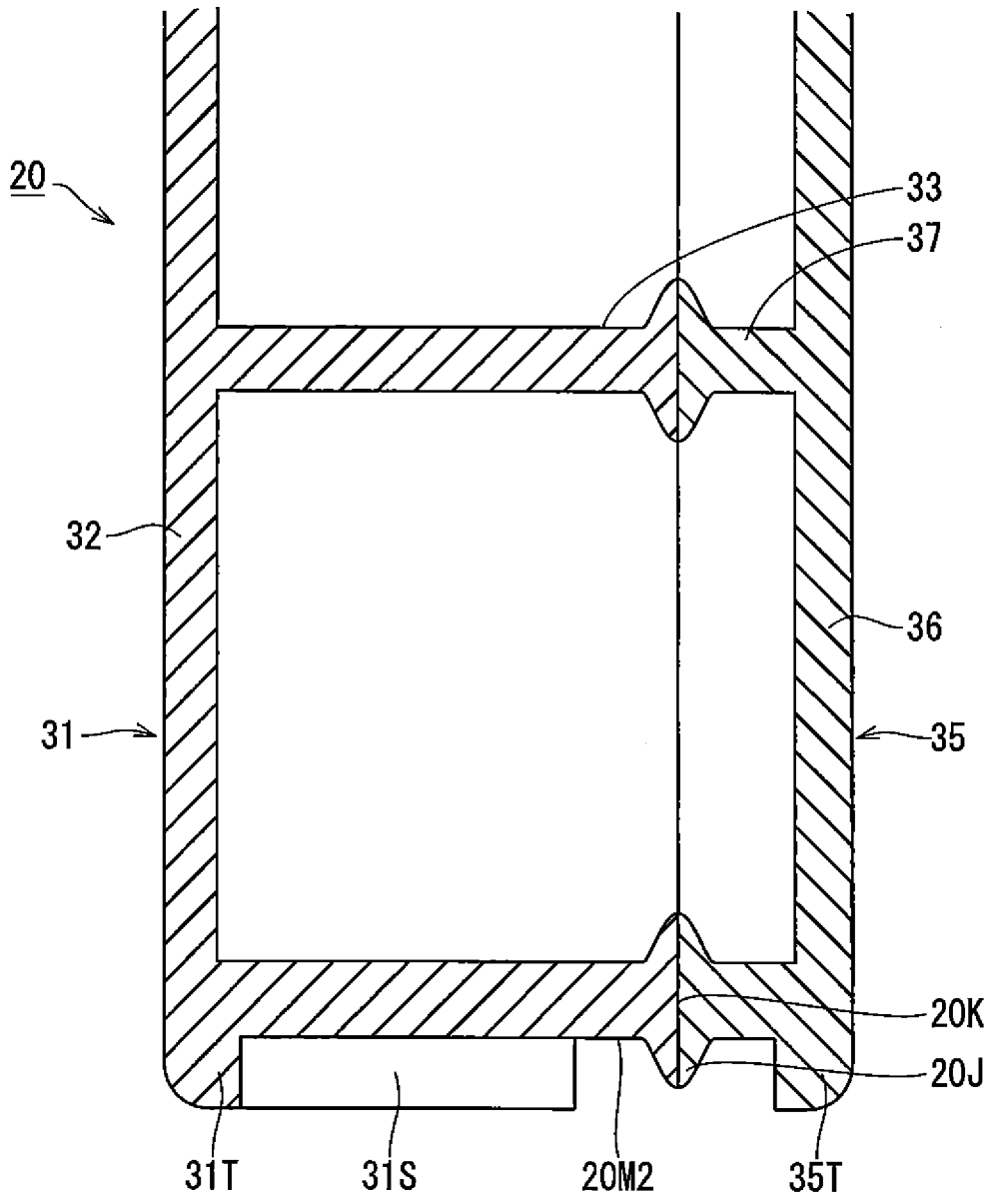
FIG. 23 is a sectional view of an excess resin protrusion in the first pallet side wall.

Moreover, as shown in FIG. 10A, from both upper and lower side surfaces of the box-shaped operating portion 27A, sliding lock projection pieces 27E, 27E are projected, and these sliding lock projection pieces 27E, 27E are, as shown in FIG. 22, engaged with back surfaces of the sliding lock pieces 28C, 28C of the slider receiving portion 28. Accordingly, the coupling slider 27 is retained within the slider receiving portion 28. Moreover, the tip ends of the sliding lock projection pieces 27E, 27E are butted against upper and lower inner side surfaces of the slider receiving portion 28, and the coupling slider 27 is accordingly supported so as to be immovable up and down within the slider receiving portion 28.

Figure 10B:
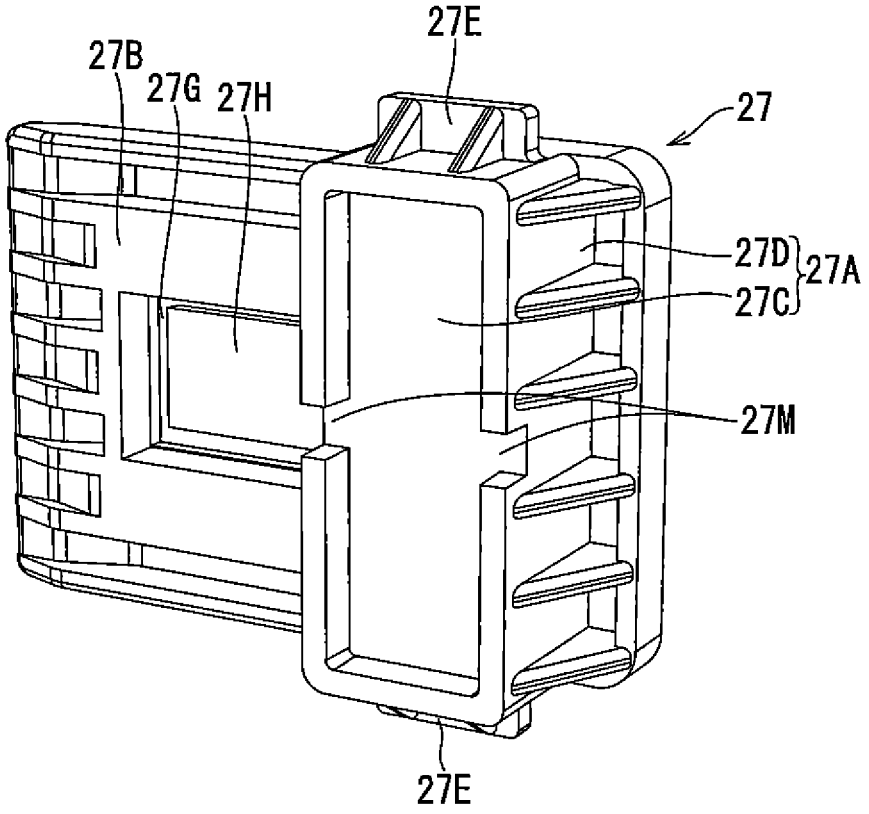
FIG. 10B is a perspective view of a back side of the coupling slider.

As shown in FIG. 10B, in one end portion of the box-shaped operating portion 27A, an engagement groove 27M to be engaged with the guide protrusion 28F (refer to FIG. 9B) of the slider receiving portion 28 is formed. And, as shown by comparison in FIG. 11A and FIG. 11B, the coupling slider 27 linearly moves in the left-right direction with respect to the first pallet side wall 20 in the range of a difference in transverse width between the box-shaped operating portion 27A and the outer surface opening 28B of the slider receiving portion 28.

Figure 11A:
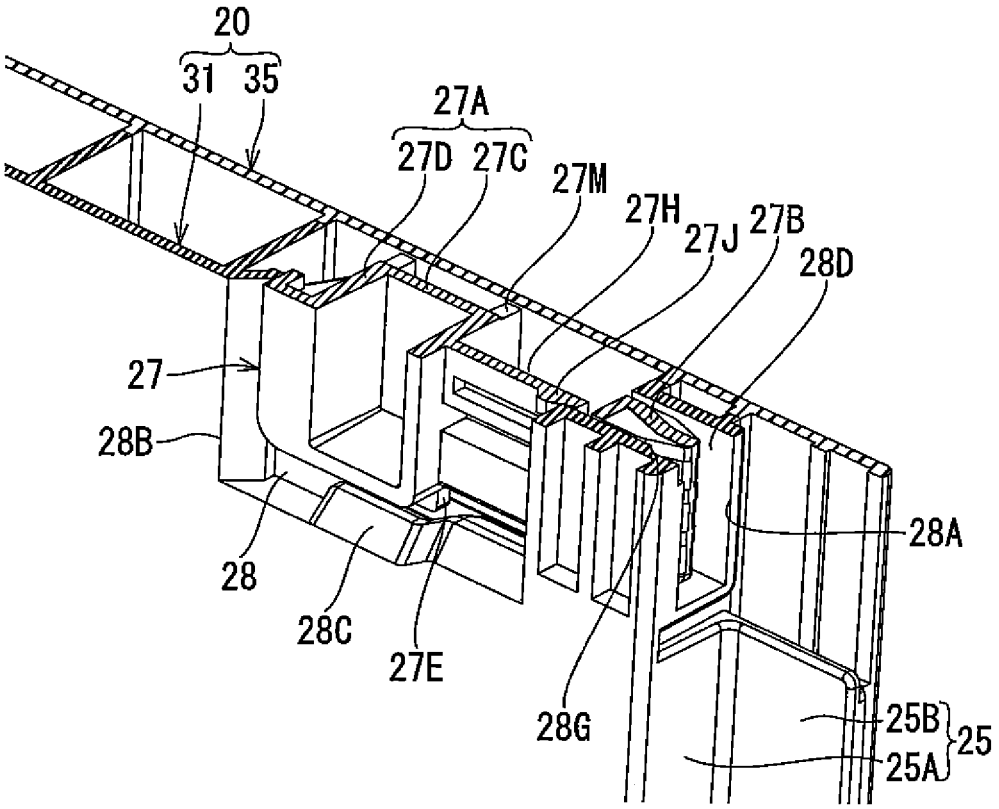
FIG. 11A is a partially broken away perspective view of the coupling slider disposed at one end side of the slider receiving portion.
Figure 11B:
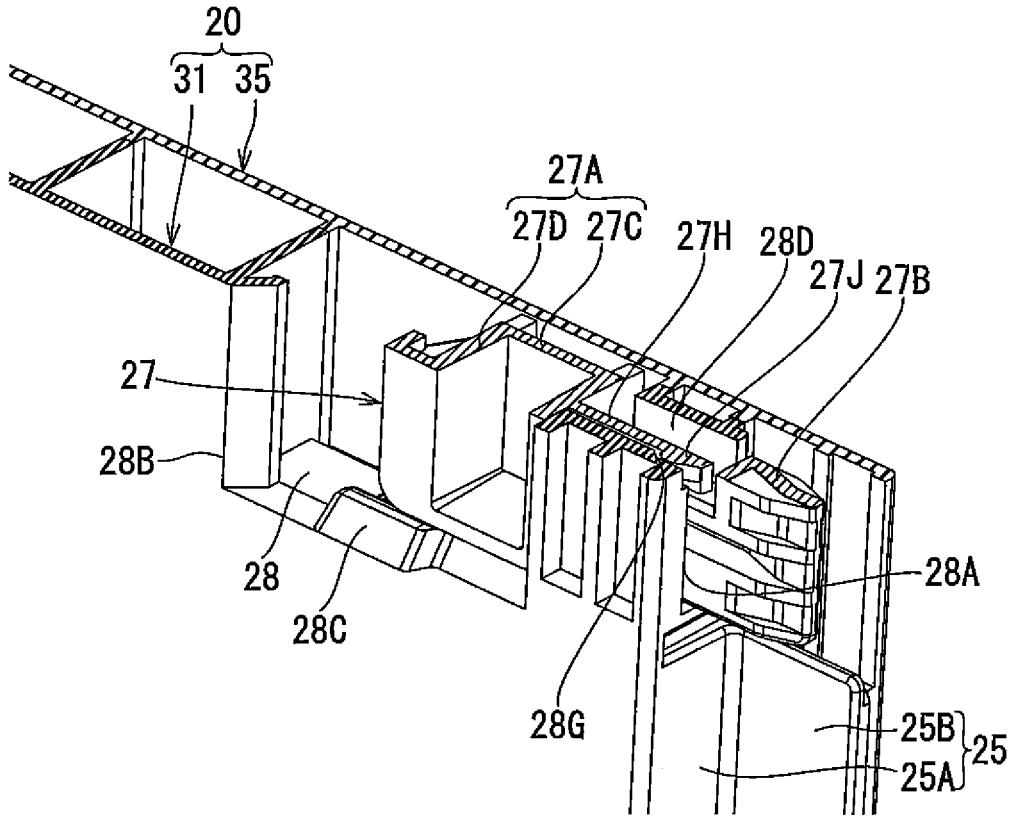
FIG. 11B is a partially broken away perspective view of the coupling slider disposed at the other end side of the slider receiving portion.

From one side surface of the box-shaped operating portion 27A, a project-into piece 27B projects toward the guide hole 28D of the slider receiving portion 28. And, when the coupling slider 27 is disposed at a releasing position being one end of the movable range, as shown in FIG. 11A, the project-into piece 27B is housed within the guide hole 28D, not to project from the stepped surface opening 28A, and when the coupling slider 27 is disposed at a side wall joining position being the other end of the movable range, as shown in FIG. 11B, the tip end of the project-into piece 27B projects outside from the stepped surface opening 28A. Moreover, as shown in FIG. 10A, in the engagement projection piece 27B, a gate-shaped slit 27G is formed at the center in the width direction, and the inside of the slit 27G serves as an elastic lock piece 27H. Moreover, a lock projection 27J projects from an outer surface of the tip end of the elastic lock piece 27H. In response thereto, at an inner surface of the guide hole 28D, a locking stepped portion 28G is formed as shown in FIG. 11A, and when the coupling slider 27 is disposed at the side wall joining position, as shown in FIG. 11B, the lock projection 27J of the elastic lock piece 27H is locked at the locking stepped portion 28G.

Figure 12:
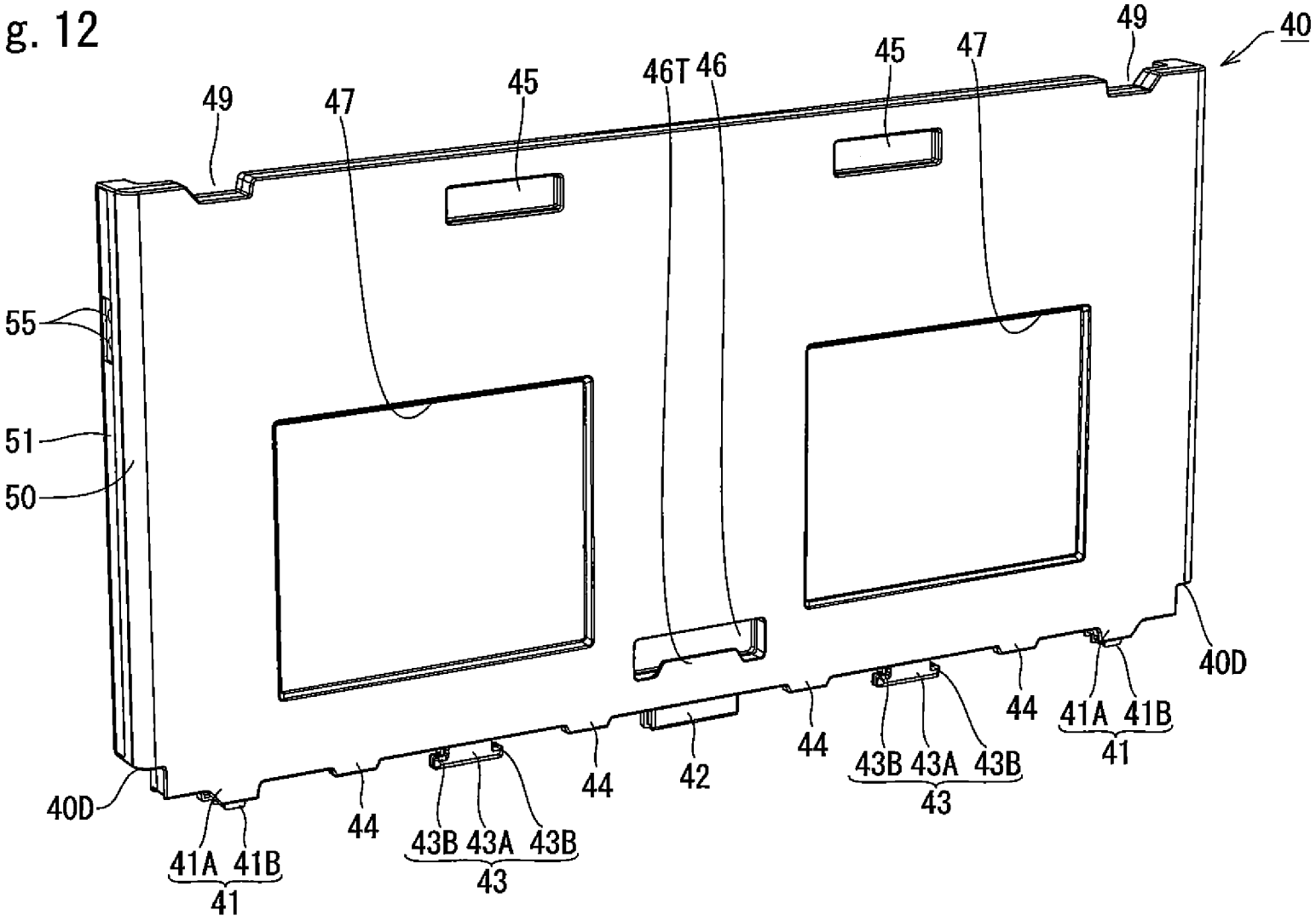
FIG. 12 is a perspective view of an outer surface side of the second pallet side wall.

Next, detailed structures other than the internal structure will be described in detail for the second pallet side wall 40. As shown in FIG. 12, the second pallet side wall 40 is in a rectangular shape that is transversally long in its entirety, and is provided at a lower surface with first to fourth insertion projection portions 41, 42, 43, 44. The first insertion projections 41 are disposed at positions close to both end portions in the longitudinal direction of the lower surface of the second pallet side wall 40, and the second insertion projection portion 42 is disposed at the longitudinal center of the lower surface of the second pallet side wall 40. Moreover, the third insertion projection portions 43 are disposed at respective intermediate positions between each first insertion projection portion 41 and the second insertion projection portion 42, and the fourth insertion projection portions 44 are respectively disposed between the neighboring first and third insertion projection portions 41, 43 and between the neighboring second and third insertion projection portions 42, 43.

Figure 14:
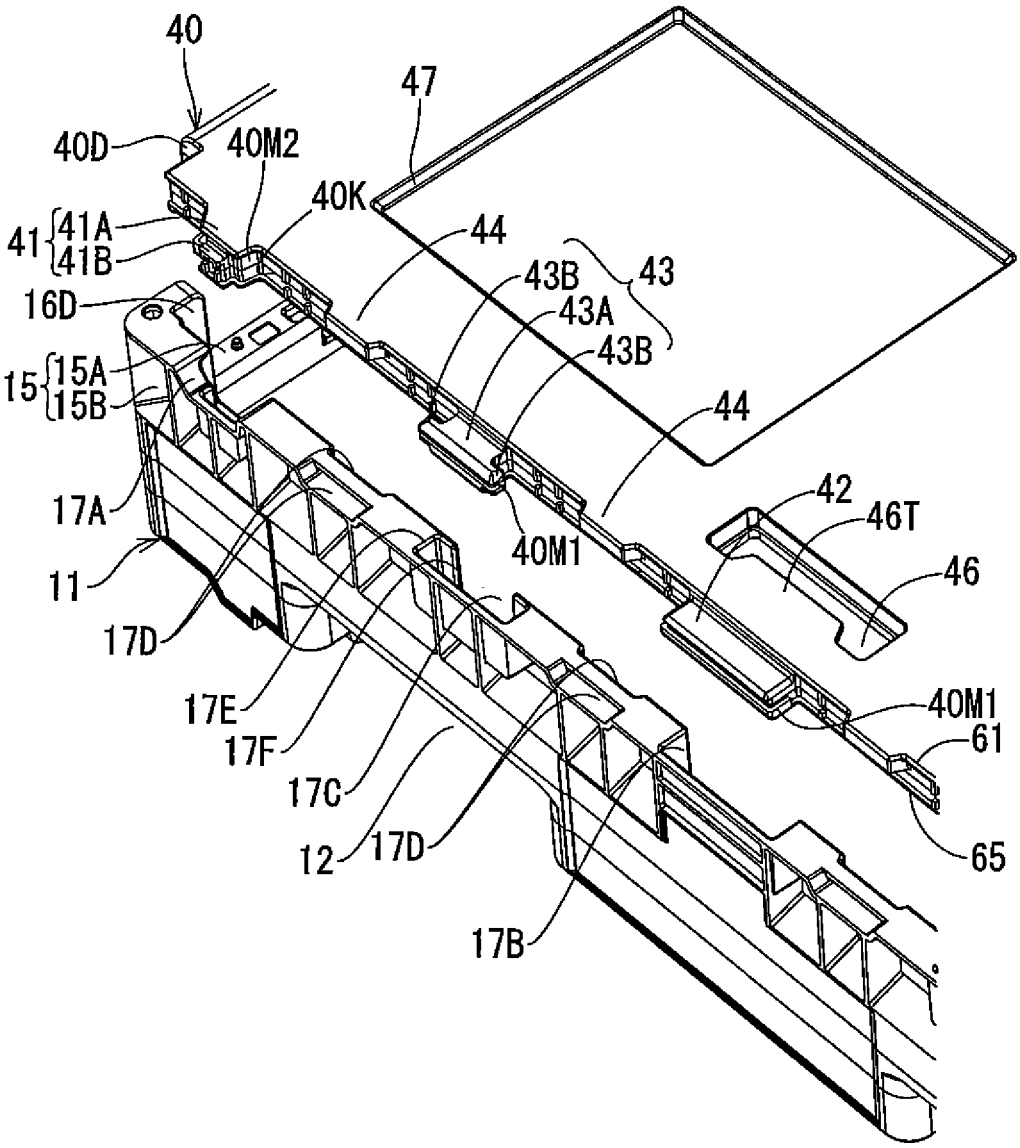
FIG. 14 is a perspective view of the second pallet side wall and the insertion support portion.
Figure 15:
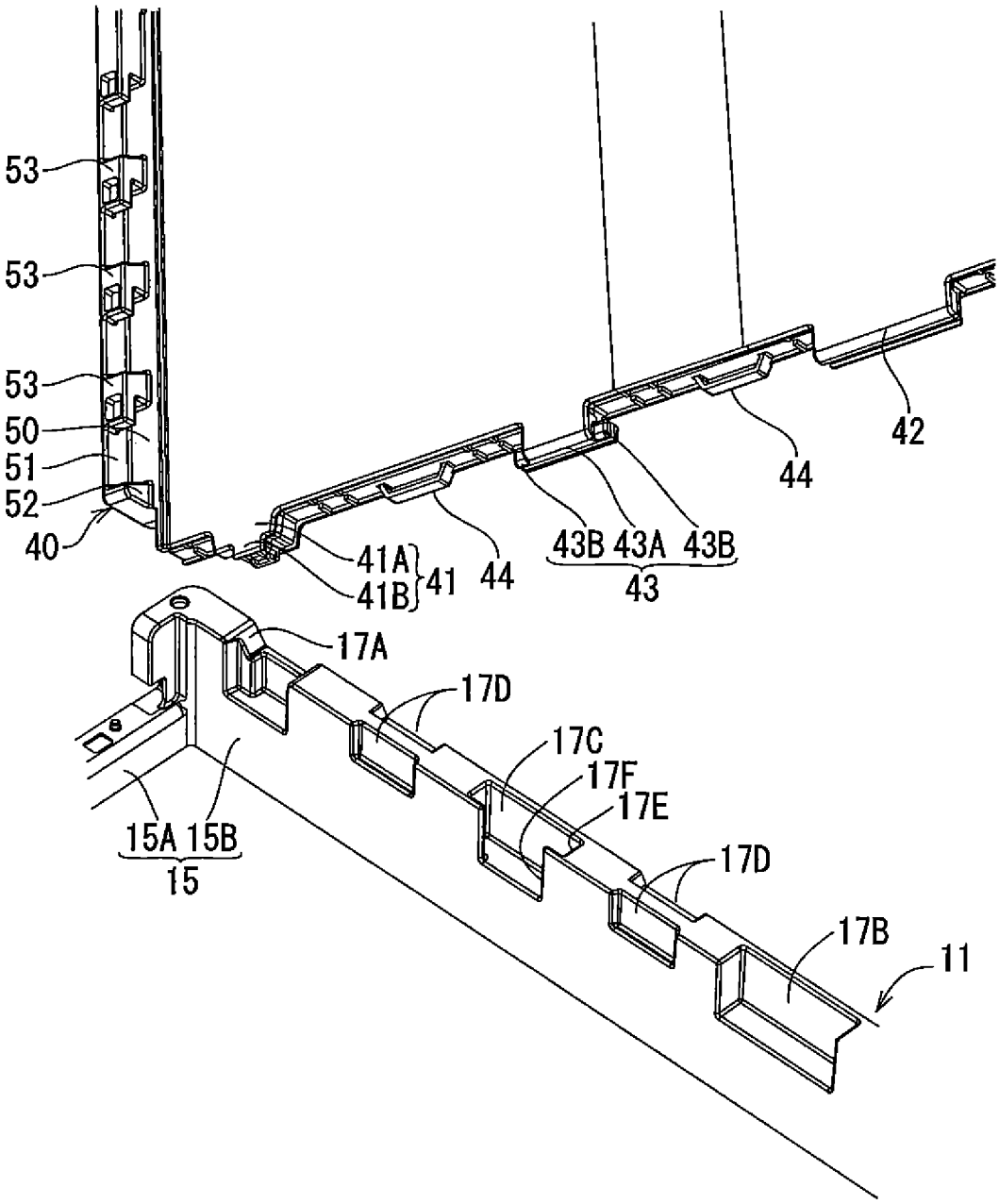
FIG. 15 is a perspective view of the second pallet side wall and the insertion support portion.

The first insertion projection portion 41 is, when viewed from the thickness direction of the second pallet side wall 40, as shown in FIG. 14, in a shape in which a projection portion 41B is projected from a lower surface of a trapezoidal base portion 41A having a narrower width toward the downside. Moreover, the second insertion projection portion 42 is in a transversally long rectangular shape. Moreover, the third insertion projection portion 43 is in a shape in which latch projection portions 43B, 43B are projected from both side surfaces at the lower end of a transversally long rectangular-shaped base portion 43A. Moreover, the fourth insertion projection portion 44 is in a transversally long trapezoidal shape. Further, the fourth insertion projection portions 44 are, as shown in FIG. 15, disposed close to the outer surface side of the second pallet side wall 40 in the thickness direction of the second pallet side wall 40.

In response to these first to fourth insertion projection portions 41, 42, 43, 44 of the second pallet side wall 40, first to fourth receiving recess portions 17A, 17B, 17C, 17D are provided in the insertion support portion 15B of the pallet main body 11. Those first to fourth receiving recess portions 17A, 17B, 17C, 17D are depressed with respect to both surfaces of an upper surface and inner side surface of the insertion support portion 15B. Moreover, of the third receiving recess portion 17C corresponding to the third insertion projection portion 43, a side surface opening 17F located in the inner side surface of the insertion support portion 15B is narrower in width than an upper surface opening 17E located in the upper surface of the insertion support portion 15B, so that only the base portion 43A of the third insertion projection portion 43 can pass through the side surface opening 17F.

Figure 30:
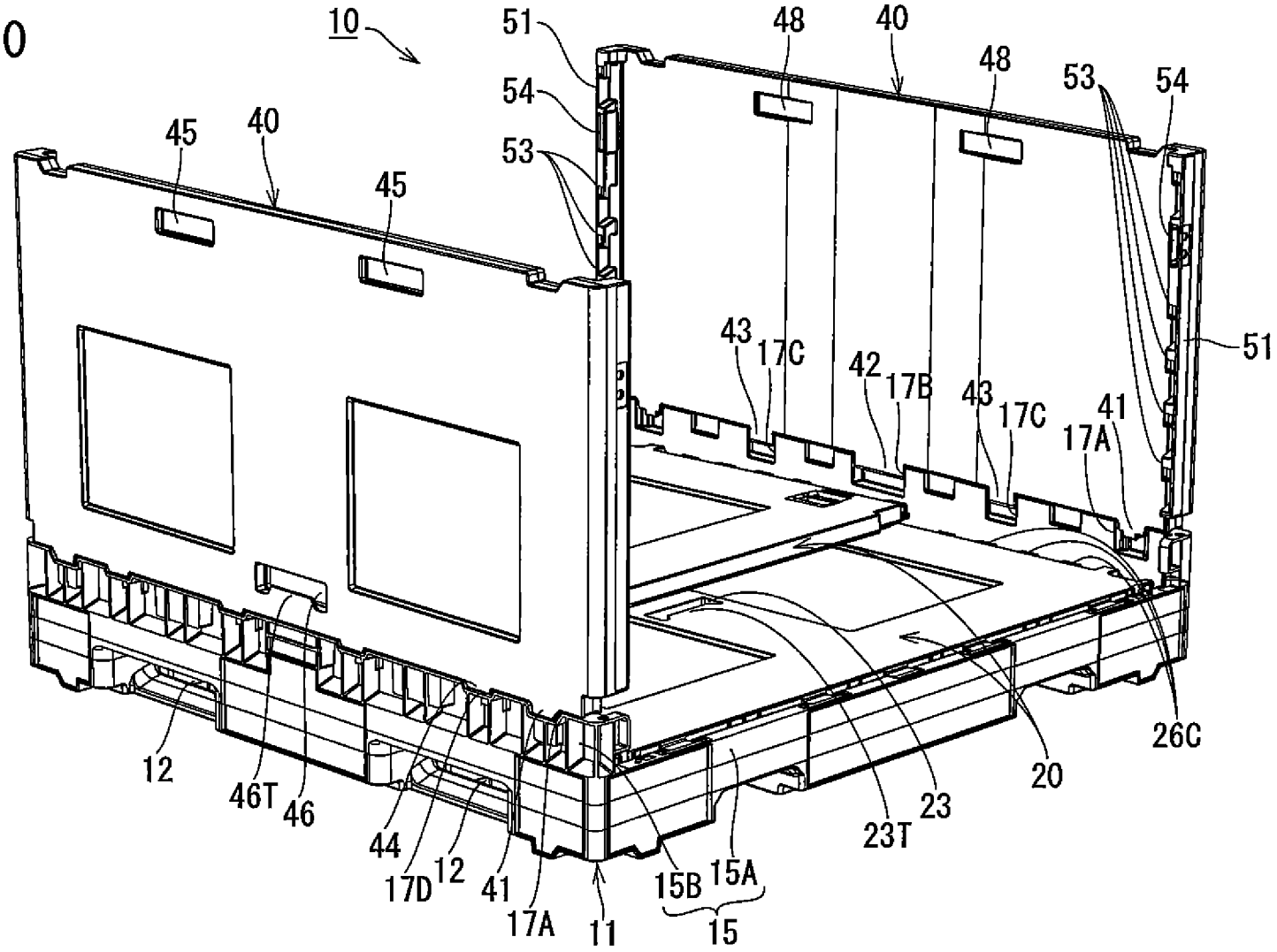
FIG. 30 is a perspective view of the box pallet with the first pallet side walls folded down.

And, as shown in FIG. 30, by erecting the second pallet side wall 40 on the insertion support portion 15B, the first to fourth insertion projection portions 41, 42, 43, 44 are configured to be insertable into the first to fourth receiving recess portions 17A, 17B, 17C, 17D. Accordingly, a lower end portion of the second pallet side wall 40 is held so as to be immovable horizontally. Moreover, as shown in FIG. 14, when removing the second pallet side wall 40 from the pallet main body 11 and bringing the same into a horizontal position to be placed on the pallet main body 11, by inserting the latch projection portions 43B of the third insertion projection portion 43 into the interior from the upper surface opening 17E of the third receiving recess portion 17C and disposing the base portion 43A of the third insertion projection portion 43 in the side surface opening 17F of the third receiving recess portion 17C, the second pallet side wall 40 is held so as to be immovable horizontally. At this time, the first, second, and fourth insertion projections 41, 42, 44 reach a state of being received through the openings at the inner side surface side of the insertion support portion 15B with respect to the first, second, and fourth receiving recess portions 17A, 17B, 17D.

As shown in FIG. 1, on an outer surface of the second pallet side wall 40, an outer surface lower end handhold portion 46 is formed by depression at the center in a lower end portion. The outer surface lower end handhold portion 46 has the same shape as the handhold portion 23 of the first pallet side wall 20 as described above, and includes a projection piece 46T at its lower end opening edge. Moreover, in an upper edge portion of the outer surface of the second pallet side wall 40, a pair of outer-surface upper end handhold recess portions 45, 45 having transversally long rectangular shapes are formed by depression aligned transversally, and in an upper end portion of an inner surface of the second pallet side wall 40, a pair of inner-surface upper end handhold recess portions 48, 48 having transversally long rectangular shapes are formed by depression aligned transversally. The outer-surface upper end handhold recess portions 45, 45 and the inner-surface upper end handhold recess portions 48, 48 have the same shape, and are disposed at positions to be front and back with respect to each other.

On both sides of the outer surface lower end handhold portion 46 in the outer surface of the second pallet side wall 40, outer surface depression portions 47, 47 are provided in which the outer surface of the second pallet side wall 40 is depressed slightly. The outer surface depression portion 47 is in a quadrilateral shape, and is formed in a range extending from a position close to the lower end of the second pallet side wall 40 to a position close to the upper center in the up-down direction, and extending from the center of the second pallet side wall 40 to a position close to a side portion in the left-right direction.

Figure 13:
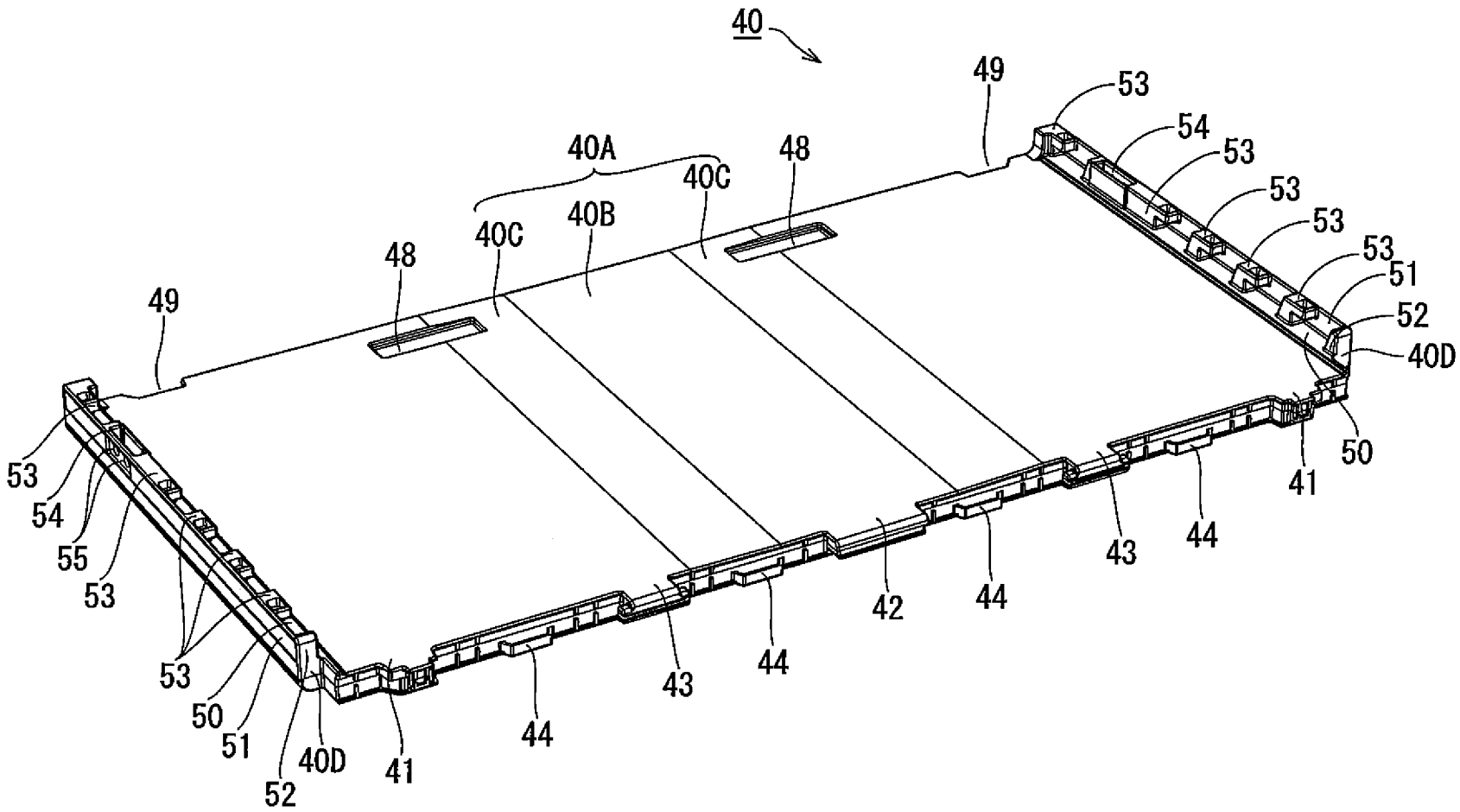
FIG. 13 is a perspective view of an inner surface side of the second pallet side wall.

As shown in FIG. 13, a central part in the left-right direction of the inner surface of the second pallet side wall 40 serves as a slightly sunken central depression portion 40A. The central depression portion 40A is in a shape including, on both sides of a depressed bottom surface 40B extending at a fixed width throughout the whole in the up-down direction of the second pallet side wall 40, gentle slopes 40C, 40C that are gently inclined.

Figure 8:
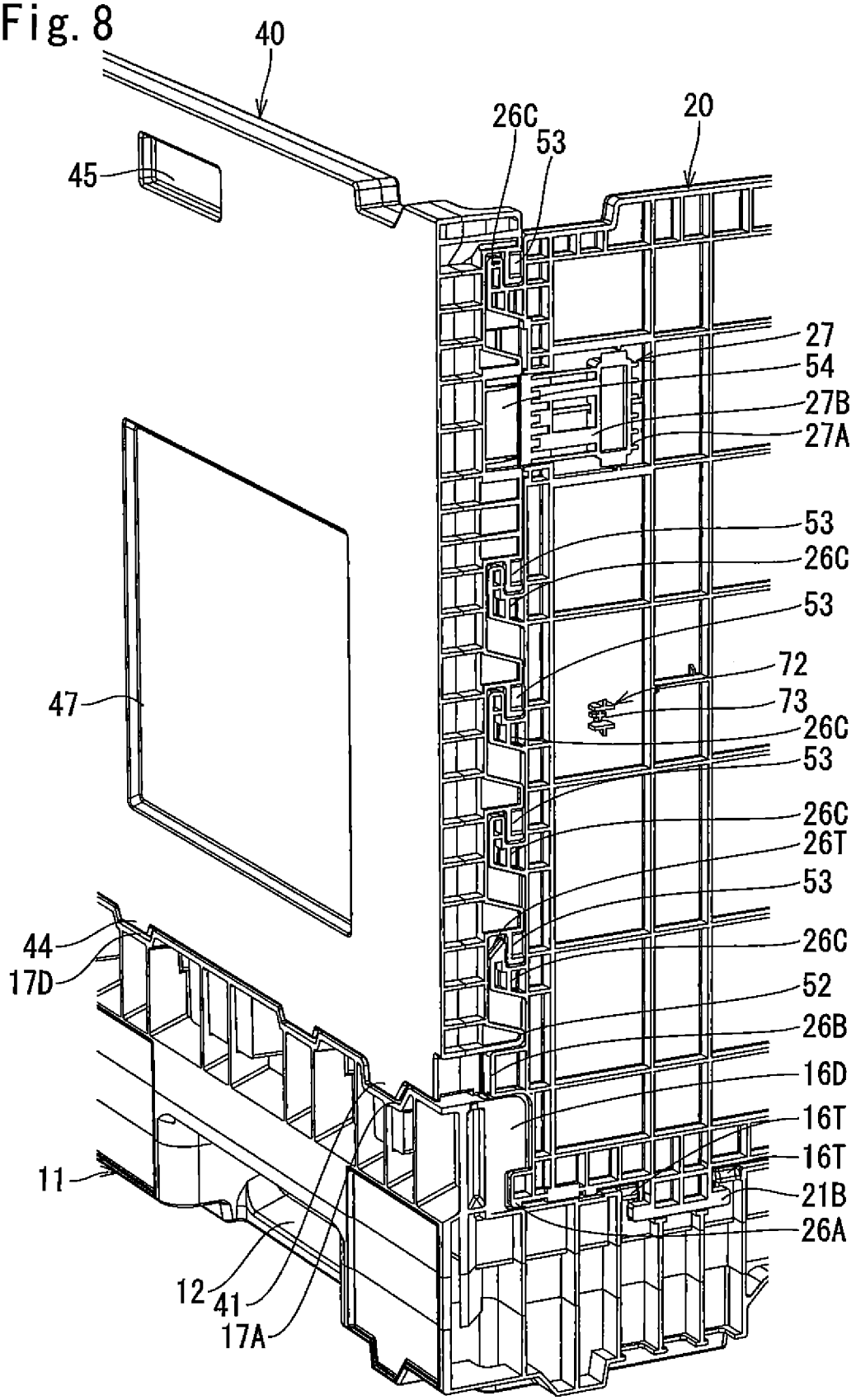
FIG. 8 is a partially broken away perspective view of the box pallet in a state where upward engaging hooks and downward engaging hooks are engaged.

At lower end portions in both side edge portions of the second pallet side wall 40, stepped portions 40D, 40D are formed, and parts upper than those stepped portions 40D, 40D are side edge joining base portions 50, 50 jutting more laterally than lower parts of the stepped portions 40D. Moreover, from outer side edge portions of the respective side edge joining base portions 50 in the inner surface of the second pallet side wall 40, side cover walls 51 project respectively vertically. And, a plurality of downward engaging hooks 53 are provided aligned along an inside corner portion between the side cover wall 51 and the side edge joining base portion 50. These downward engaging hooks 53 are integrally continuous with the side edge joining base portion 50 and the side cover wall 51, project in the same direction as that of the side cover wall 51 of the side edge joining base portion 50, and have their tip end portions in downwardly bent hook shapes. And, as shown in FIG. 8, each downward engaging hook 53 and each upward engaging hook 26C are engaged with each other, and accordingly, the side edge portions of the first pallet side wall 20 and the second pallet side wall 40 are joined to each other.

Figure 16:
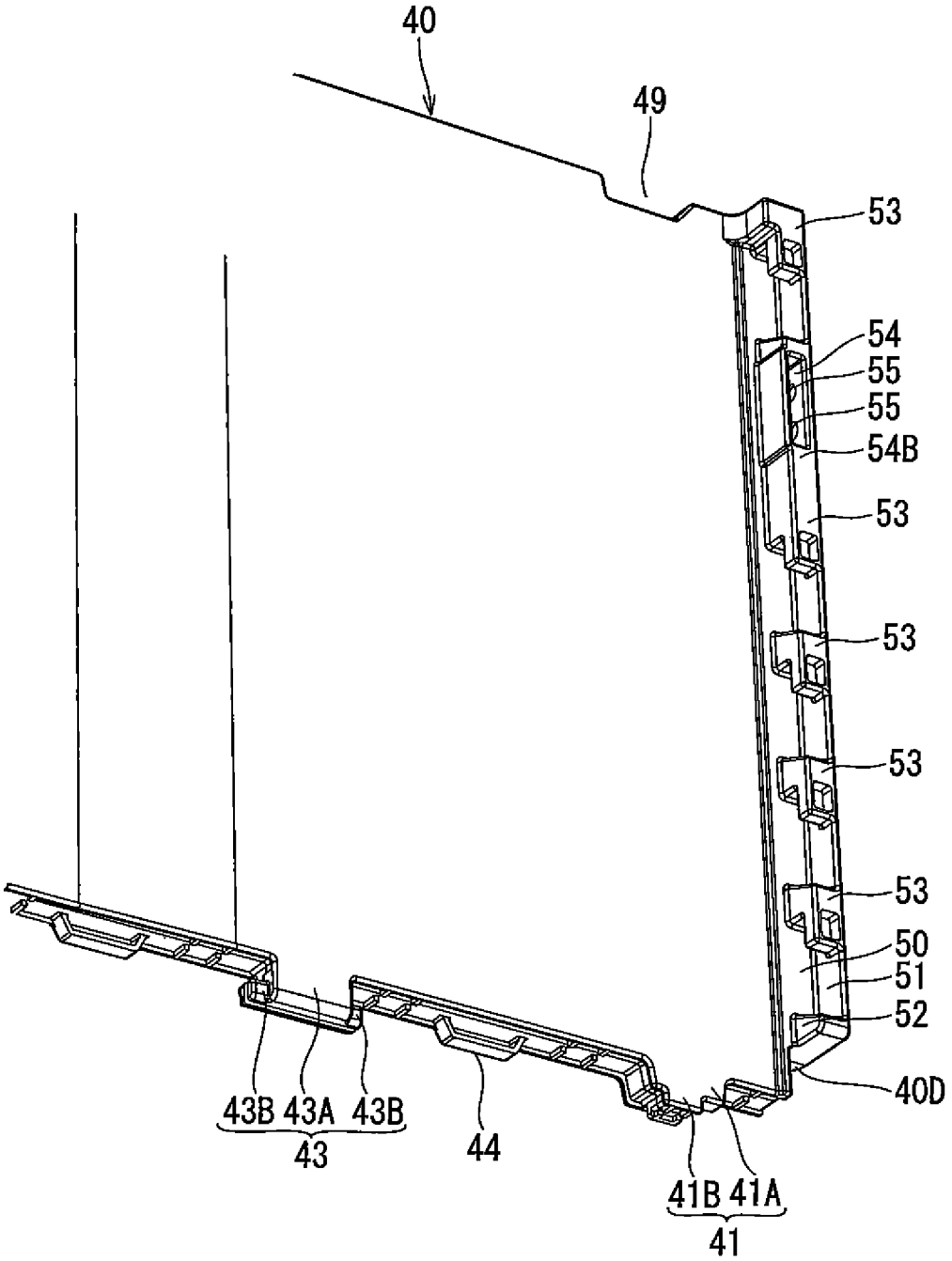
FIG. 16 is a perspective view of one side portion of the second pallet side wall.

As shown in FIG. 16, a side portion lower end wall 52 that projects in the same direction as that of the side cover wall 51 is provided in a lower end portion of the side edge joining base portion 50, and the lower end portions of the side edge joining base portion 50 and the side cover wall 51 are connected to each other by the side portion lower end wall 52. Also, as shown in FIG. 8, when the first pallet side wall 20 and the second pallet side wall 40 are assembled into an erected state on the pallet main body 11, the side portion lower end wall 52 is placed on the second side surface projection portion 26B of the first pallet side wall 20.

As shown in FIG. 16, in the second pallet side wall 40, an engaging box portion 54B is integrally provided above the second topmost downward engaging hook 53, and the inside of the engaging box portion 54B serves as an engaging recess portion 54 that is opened toward the first pallet side wall 20. And, the engagement projection piece 27B (refer to FIG. 9B) of the coupling slider 27 in the first pallet side wall 20 projects into the engaging recess portion 54, so that an upward movement of the second pallet side wall 40 with respect to the first pallet side wall 20 is restricted.

As shown in FIG. 16, in an outer surface of the side cover wall 51, peepholes 55 communicated within the engaging recess portion 54 are formed. Moreover, the coupling slider 27 is different in color from the second pallet side wall 40. And, through the peepholes 55, whether the engagement projection piece 27B is engaged within the engaging recess portion 54 can be visually checked.

Figure 29:
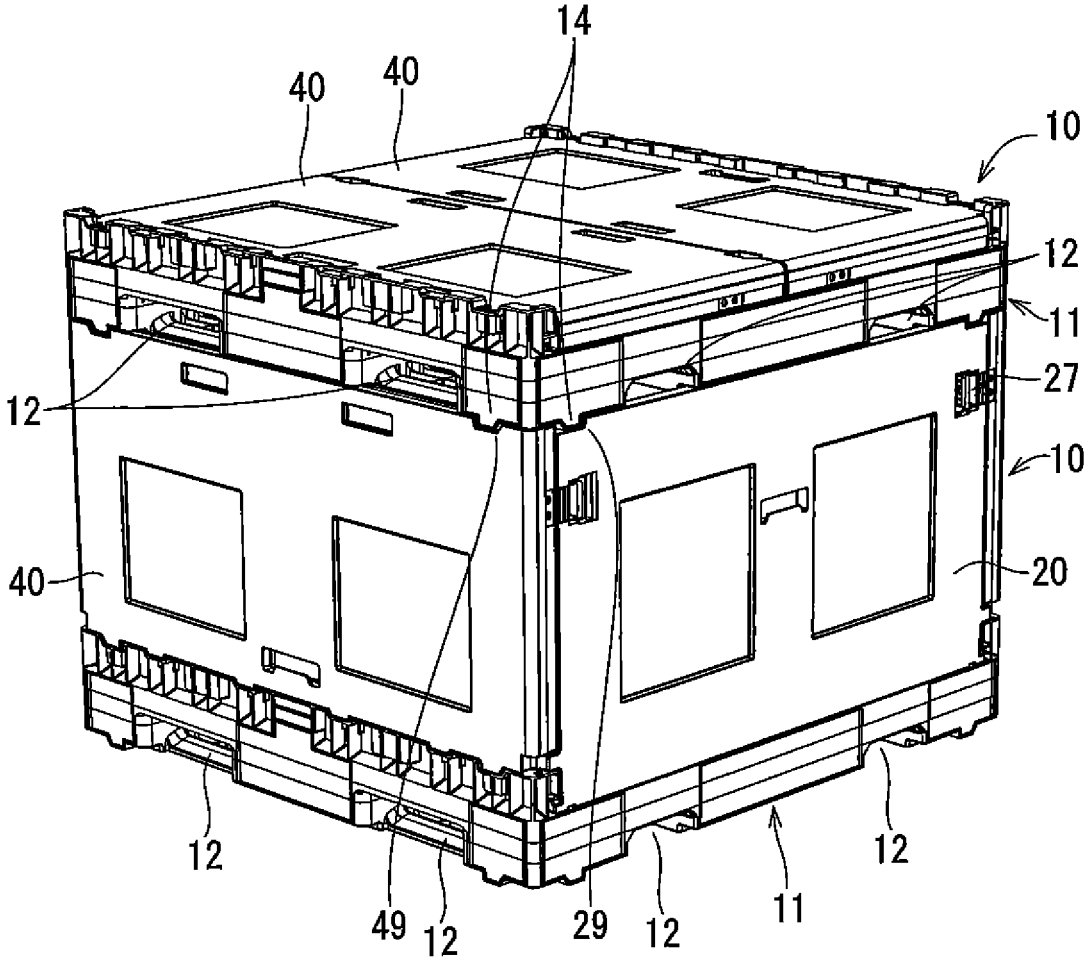
FIG. 29 is a perspective view of a state where box pallets are stacked.

As shown in FIG. 1, in both end portions of the upper surface of the second pallet side wall 40, upper surface positioning recess portions 49, 49 are formed by depression. Similar to these, upper surface positioning recess portions 29, 29 are also formed by depression in both end portions of the upper surface of the first pallet side wall 20. And, as shown in FIG. 29, when a box pallet 10 is stacked on another box pallet 10 in a state of the first pallet side wall 20 and the second pallet side wall 40 being erected, the lower surface positioning projection portions 14 in the upper box pallet 10 are configured to be fitted with the upper surface positioning recess portions 29, 49.

Now, the internal structures of the first pallet side wall 20 and the second pallet side wall 40 will be described. The first pallet side wall 20 and the second pallet side wall 40 correspond to the "box pallet side wall" of the present invention as described above, and have hollow structures. To make the hollow structures, the first pallet side wall 20 is formed by firmly fixing an outer configuration panel 31 and an inner configuration panel 35 shown in FIG. 17 and FIG. 18, and the second pallet side wall 40 is formed by firmly fixing an outer configuration panel 61 shown in FIG. 24A and FIG. 24B and an inner configuration panel 65 shown in FIG. 25A and FIG. 25B.

Figure 19:
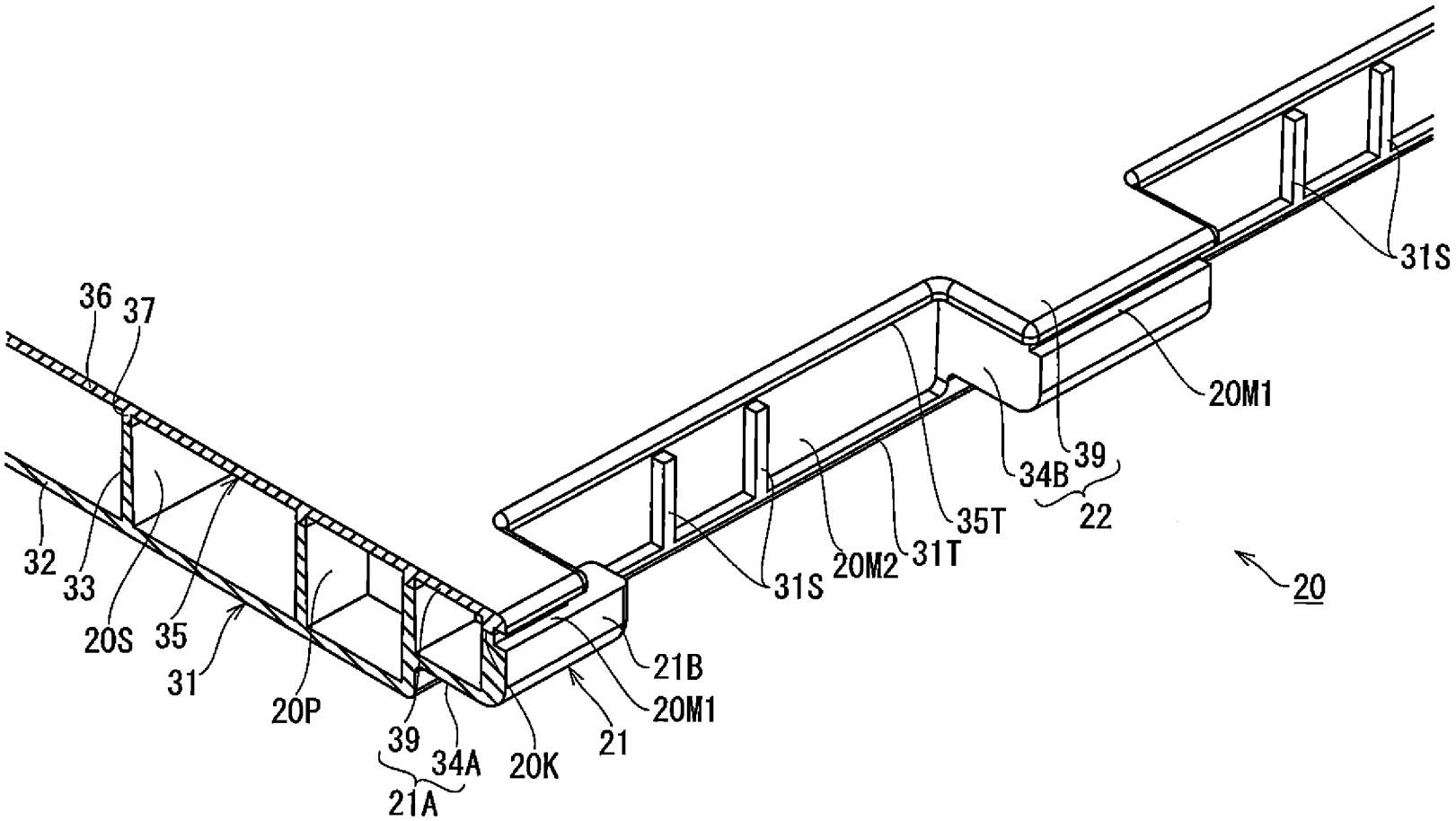
FIG. 19 is a partially broken away perspective view of the first pallet side wall.

Specifically, as shown in FIG. 19, the first pallet side wall 20 includes an outer main plate 32 and an inner main plate 36 opposed to each other across an enclosed space 20P. Moreover, between the outer main plate 32 and the inner main plate 36, a resin fixed layer 20K is provided along a plane dividing the entire first pallet side wall 20 into two parts in the thickness direction. The fixed layer 20K is disposed at a position close to the inner main plate 36 in the thickness direction of the first pallet side wall 20. And, an outer main plate 32 side from the fixed layer 20K of the first pallet side wall 20 serves as the outer configuration panel 31, and an inner main panel 36 side from the fixed layer 20K of the first pallet side wall 20 serves as the inner configuration panel 35.

Figure 17:
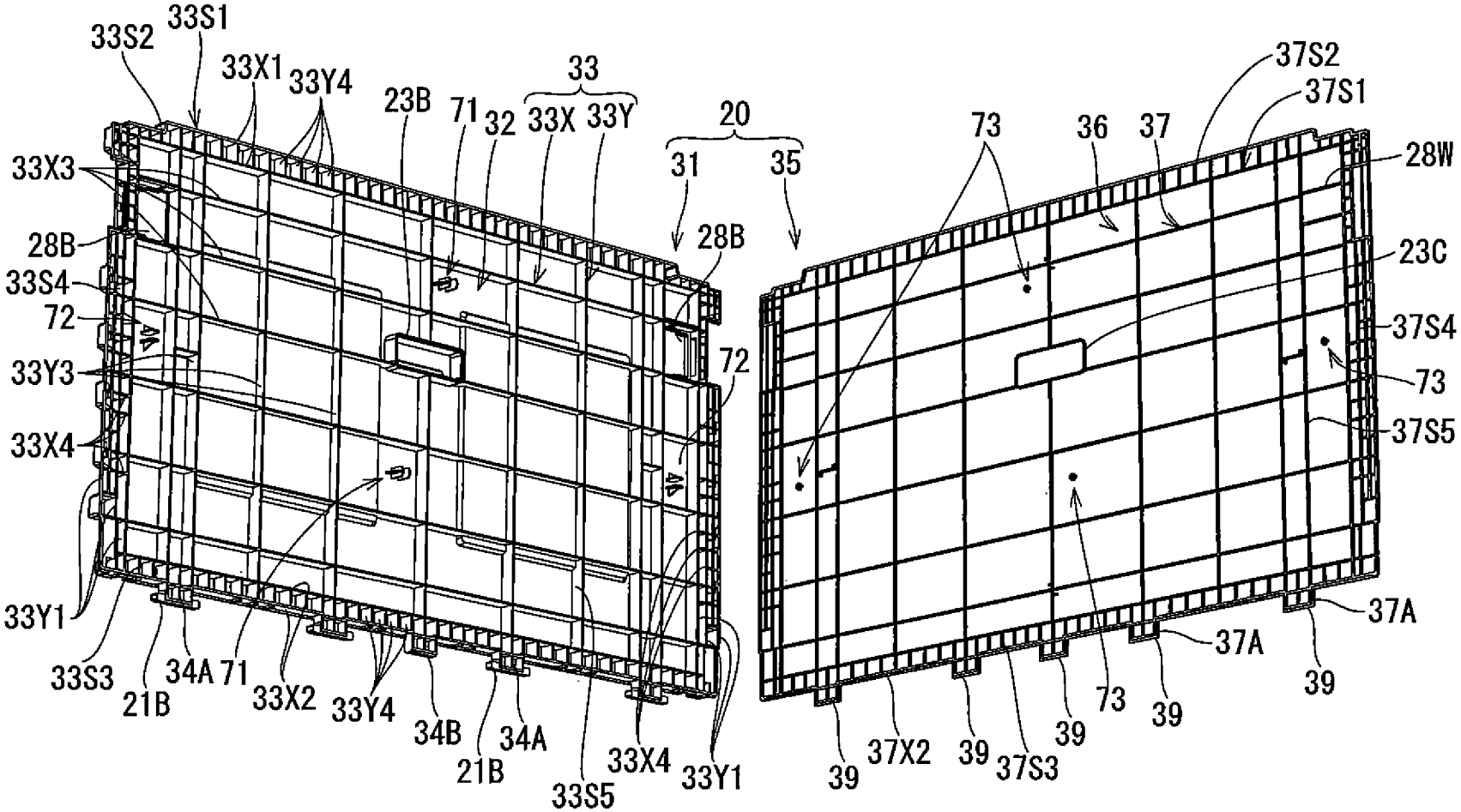
FIG. 17 is a perspective view of an inner surface side of an outer configuration panel and inner configuration panel of the first pallet side wall.
Figure 18:
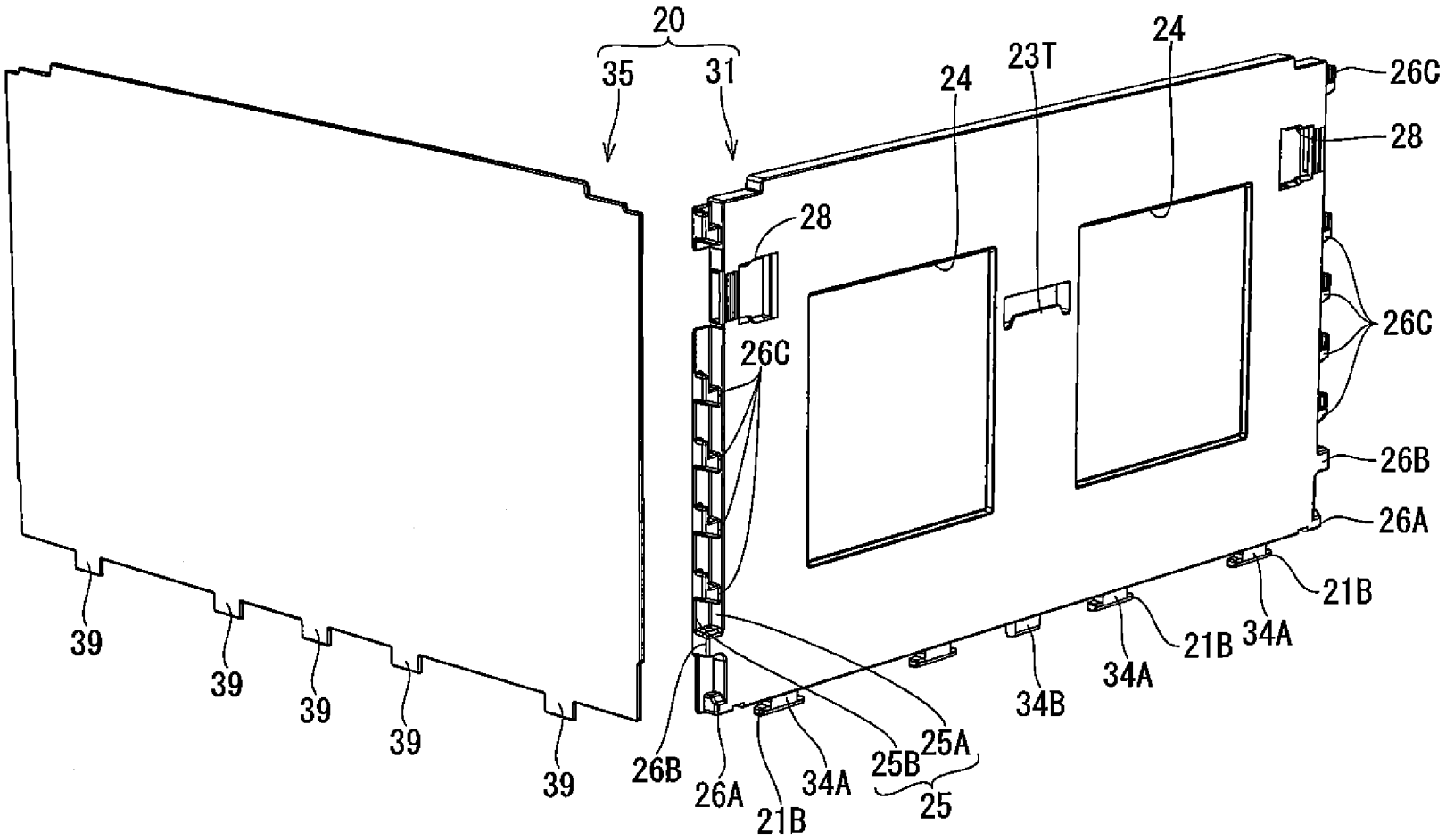
FIG. 18 is a perspective view of an outer surface side of the outer configuration panel and inner configuration panel of the first pallet side wall.

As shown in FIG. 17, the outer configuration panel 31 has a structure in which cell configuration rib 33 is laid on an entire surface opposed to the inner main panel 36 in the outer main plate 32. Moreover, the inner configuration panel 35 has a structure in which a cell configuration rib 37 is laid on a surface opposed to the outer configuration panel 31 in the inner main plate 36.

The cell configuration rib 33 of the outer configuration panel 31 is formed in a lattice-like manner, and frame-like region cells 33S1 in a frame-like region along the outer edge of the outer configuration panel 31 have meshes finer than those of central region cells 33S5 in a central region inside the frame-like region. Specifically, the cell configuration rib 33 includes a plurality of long transverse ribs 33X extending throughout substantially the whole in the transverse direction of the first pallet side wall 20 and a plurality of long longitudinal ribs 33Y extending throughout substantially the whole in the longitudinal direction of the first pallet side wall 20. And, of the long transverse ribs 33X, an interval between, for example, two upper edge long transverse ribs 33X1, 33X1 (refer to FIG. 21B) in an upper edge region of the first pallet side wall 20 and an interval between two lower edge long transverse ribs 33X2, 33X2 (refer to FIG. 20) in a lower edge region are narrower than an interval between central long transverse ribs 33X3, 33X3 (refer to FIG. 17) provided in a central region between the upper edge region and lower edge region.

Moreover, an interval of, for example, three or more, multiple side edge long longitudinal ribs 33Y1 (refer to FIG. 21A) of the long longitudinal ribs 33Y in each of side edge regions at both sides of the first pallet side wall 20 is narrower than an interval of central long longitudinal ribs 33Y3, 33Y3 provided in a central region between those side edge regions.

Further, in respective squares sectioned by the plurality of central long longitudinal ribs 33Y3 of a section between the upper edge long transverse ribs 33X1, 33X1 and a section between the lower edge long transverse ribs 33X2, 33X2, a plurality of edge portion reinforcing longitudinal ribs 33Y4 are provided in parallel with the central long longitudinal ribs 33Y3 to construct a plurality of upper edge region cells 33S2 and lower edge region cells 33S3. Moreover, in respective squares sectioned by the plurality of central long transverse ribs 33X3 of a section between the side edge long transverse ribs 33Y1, 33Y1, a plurality of edge portion reinforcing transverse ribs 33X4 are provided in parallel with the central long transverse ribs 33X3 to construct a plurality of side edge region cells 33S4. And, the upper edge region cells 33S2, the lower edge region cells 33S3, and both side regions 33S4, 33S4 construct frame-like region cells 33S1, and these frame-like region cells 33S1 have meshes finer than those of the central region cells 33S5 sectioned by the central long transverse ribs 33X3 and the central long longitudinal ribs 33Y3 in the central region.

As shown in FIG. 17, similar to the cell configuration rib 33 of the outer configuration panel 31, the cell configuration rib 37 of the inner configuration panel 35 is also formed in a lattice-like manner, and frame-like cells 37S1 in a frame-like region along the outer edge of the inner configuration panel 35 have meshes finer than those of central region cells 37S5 in a central region. And, tip end portions of the cell configuration rib 33 of the outer configuration panel 31 and the cell configuration rib 37 of the inner configuration panel 35 are firmly fixed to each other, the outer main plate 32 and the inner main plate 36 are joined by those cell configuration ribs 33, 37, and the enclosed space 20P in the first pallet side wall 20 is demarcated into a plurality of cells 20S (small rooms) by the cell configuration ribs 33, 37 (refer to FIG. 19).

In the present embodiment, the outer configuration panel 31 and the inner configuration panel 35 are firmly fixed, for example, by heat welding. In the heat welding, the outer configuration panel 31 and the inner configuration panel 35 are disposed between a pair of opposing jigs (not shown) with the outer configuration panel 31 and the inner configuration panel 35 joined. And, the outer configuration panel 31 and the inner configuration panel 35 are sandwiched between the pair of opposing jigs, and the outer configuration panel 31 and the inner configuration panel 35 are separately fixed to the respective opposing jigs, and as a result of those jigs separating from each other, the outer configuration panel 31 and the inner configuration panel 35 are separated. In this state, a heated iron plate is disposed between the outer configuration panel 31 and the inner configuration panel 35. Then, after pressing joint surfaces of the outer configuration panel 31 and the inner configuration panel 35 against the heated iron plate so as to melt, by evacuating the iron plate and then approximating the pair of opposing jigs, the outer configuration panel 31 and the inner configuration panel 35 are pressed against each other to be firmly fixed.

For the first pallet side wall 20 of the present embodiment, in order to position and join the outer configuration panel 31 and the inner configuration panel 35 with each other before fixing these to the pair of opposing jigs mentioned above, as shown in FIG. 17, transverse positioning portions 71 and longitudinal positioning portions 72 are provided on the outer configuration panel 31, and positioning fitting projection portions 73 are provided on the inner configuration panel 35.

Specifically, the transverse positioning portions 71 are for positioning the outer configuration panel 31 and the inner configuration panel 35 with each other in the transverse direction and then fixing the panels, and are disposed, in the outer main plate 32, for example, at two places of a position close to the upper end and a position close to the lower end in substantially the center in the left-right direction of the outer main plate 32, for example. On the other hand, the longitudinal positioning portions 72 are for positioning the outer configuration panel 31 and the inner configuration panel 35 with each other in the longitudinal direction and then fixing the panels, and are provided at two positions of both end portions in the left-right direction in substantially the center in the up-down direction of the outer main plate 32, for example. And, the positioning fitting projection portions 73 are disposed at positions opposed to the respective transverse positioning portions 71 and the respective longitudinal positioning portions 72 in the inner main plate 36.

Figure 21A:
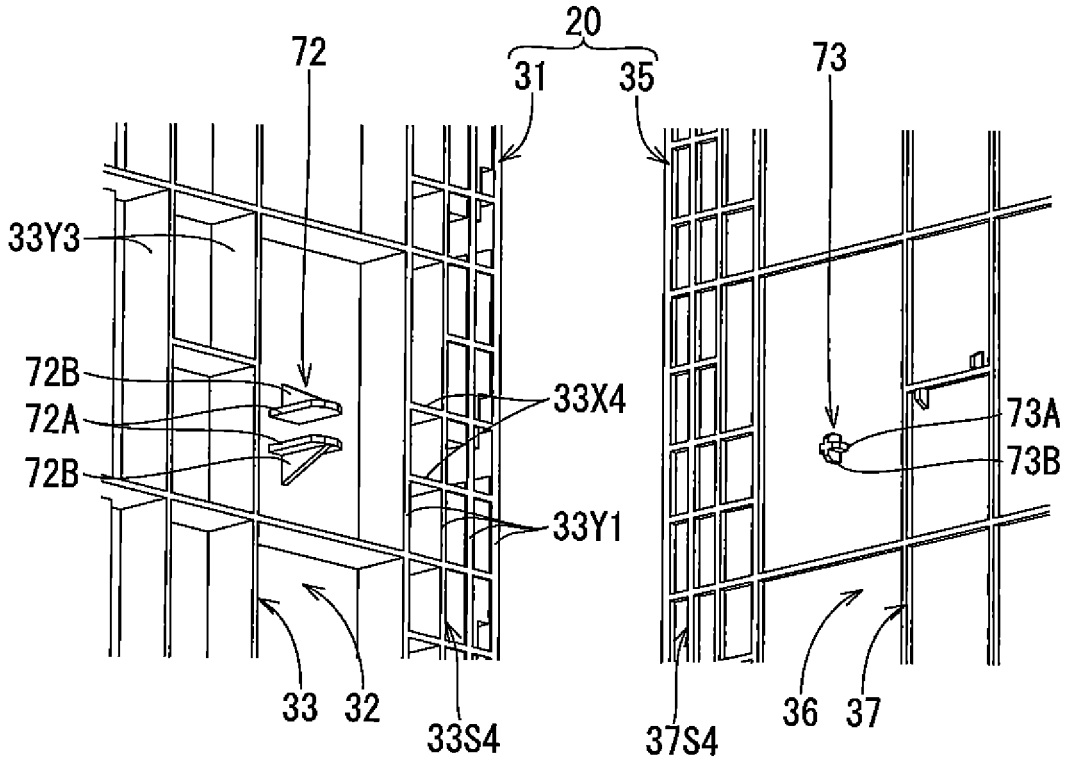
FIG. 21A is a perspective view of a longitudinal positioning portion and a positioning fitting projection portion.
Figure 21B:
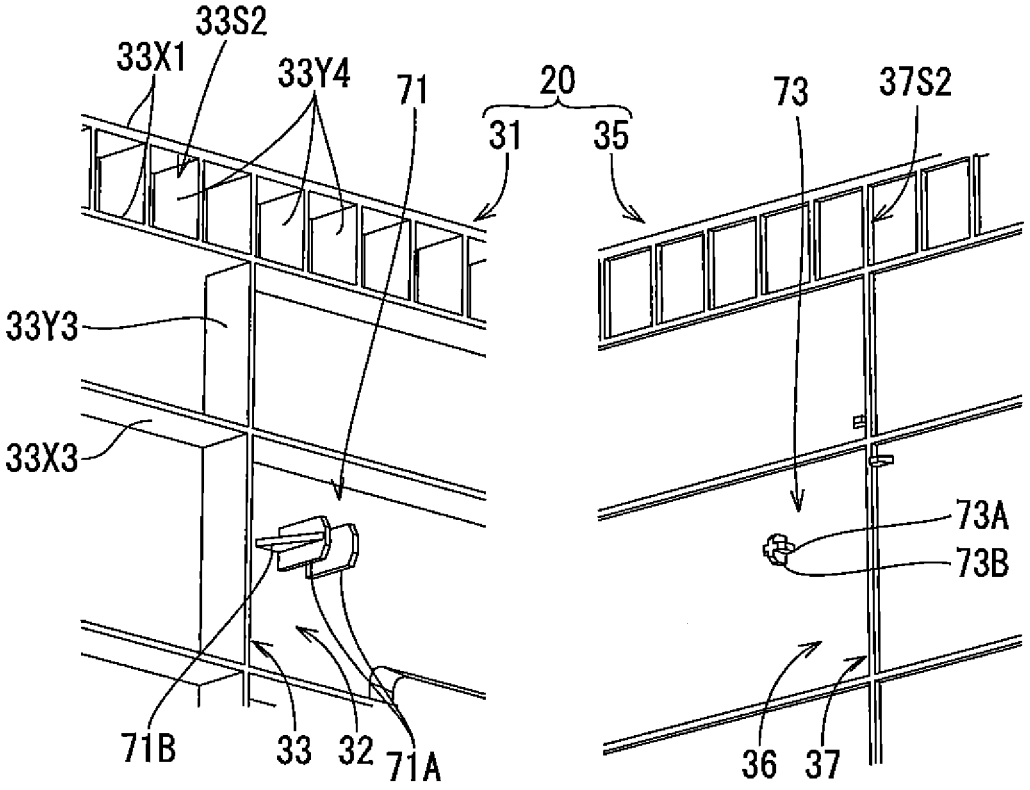
FIG. 21B is a perspective view of a transverse positioning portion and a positioning fitting projection.

FIG. 21A and FIG. 21B show the transverse positioning portion 71, the longitudinal positioning portion 72, and the positioning fitting projection portions 73 in a state before the outer configuration panel 31 and the inner configuration panel 35 are firmly fixed. The longitudinal positioning portion 72, as shown in FIG. 21A, has a structure in which a pair of opposing ribs 72A, 72A opposed to each other in the longitudinal direction of the outer configuration panel 31 are reinforced by reinforcing triangular ribs 72B, 72B from the back sides of their opposing surfaces. Moreover, the transverse positioning portion 71, as shown in FIG. 21B, has a shape in which the longitudinal positioning portion 72 is rotated by 90 degrees, and has a structure in which a pair of opposing pieces 71A, 71A opposed to each other in the transverse direction of the outer configuration panel 31 are reinforced by reinforcing triangular ribs 71B, 71B. In response thereto, the positioning fitting projection portion 73 has a "+" shape in section, and has a structure in which a first project-into piece 73A having the thickness oriented to the longitudinal direction of the inner configuration panel 35 and a second project-into piece 73B having the thickness direction oriented in the transverse direction are intersected with each other at the centers in their width directions. Moreover, both corner portions at the tip end in the first and second project-into pieces 73A, 73B are chamfered.

In the state before the outer configuration panel 31 and the inner configuration panel 35 are firmly fixed, the transverse positioning portions 71 and the longitudinal positioning portions 72 mentioned above are higher than the cell configuration rib 33, and the positioning fitting projection portions 73 are higher than the cell configuration rib 37. Then, when the outer configuration panel 31 and the inner configuration panel 35 not having been fitted yet to the pair of opposing jigs mentioned above are joined to each other, the outer configuration panel 31 and the inner configuration panel 35 are positioned in the longitudinal direction as a result of the positioning fitting projection portion 73 being fitted between the opposing pieces 72A, 72A of the longitudinal positioning portion 72, and the outer configuration panel 31 and the inner configuration panel 35 are positioned in the transverse direction as a result of the positioning fitting projection portion 73 being fitted between the opposing pieces 71A, 71A of the transverse positioning portion 71. And, the transverse positioning portions 71, the longitudinal positioning portions 72, and the positioning fitting projection portions 73 are, after the outer configuration panel 31 and the inner configuration panel 35 are fixed to the pair of opposing jigs, pressed against an iron plate for heat welding to be melted at the tip ends, and are reduced in height to a level equivalent to the cell configuration rib 33 or the cell configuration rib 37.

Also, if relief holes corresponding to the transverse positioning portions 71, the longitudinal positioning portions 72, and the positioning fitting projection portions 73 are provided in the iron plate for heat welding, the transverse positioning portions 71, the longitudinal positioning portions 72, and the positioning fitting projection portions 73 can remain in the first pallet side wall 20 without the tip ends being melted.

As shown in FIG. 17, in a central region of the outer main plate 32 of the outer configuration panel 31, a transversally long rectangular-shaped through-hole to serve as an opening of the handhold portion 23 (refer to FIG. 3) mentioned above is formed, and a rectangular cylinder 23B projects from an edge portion of the through-hole. On the other hand, in a central region of the inner main plate 36, a transversally long rectangular-shaped annular rib 23C corresponding to the rectangular cylinder 23B is provided. The annular rib 23C is firmly fixed to the tip end of the rectangular cylinder 23B to construct an inner side wall of the handhold portion 23 (refer to FIG. 3). Moreover, at positions close to both corner portions at the upper end of the outer configuration panel 31, the substantially square-shaped outer surface openings 28B in the slider receiving portions 28 (refer to FIG. 3) described above are formed in a penetrating manner, and a frame wall 28V projects from an edge portion of each outer surface opening 28B as shown in FIG. 22. On the other hand, on the inner main plate 36, frame-like ribs 28W corresponding to the frame walls 28V are provided. And, the frame-like rib 28W is firmly fixed to the tip end of the frame wall 28V to construct an inner side wall of the slider receiving portion 28 (refer to FIG. 9B).

As shown in FIG. 19, the central projection portion 22 mentioned above is divided into two parts at a position close to the inner main plate 36 by the fixed layer 20K. Moreover, the projecting base portion 21A of the hinge projection portion 21 mentioned above is divided into two parts at a position close to the inner main plate 36 by the fixed layer 20K, and the turning shaft portion 21B is formed on the outer configuration panel 31 side without being divided into two parts. And, the hinge projection portion 21 and the central projection portion 22 at a side closer to the inner main plate 36 than the fixed layer 20K are constructed by a plurality of lower end projection pieces 39 extending downward from a lower end portion of the inner configuration panel 35. On the other hand, the projecting base portion 21A at a side closer to the outer main plate 32 than the fixed layer 20K is constructed by a lower end block 34A projecting on a lower surface of the outer configuration panel 31, and the central projection portion 22 at a side closer to the outer main plate 32 than the fixed layer 20K is constructed by a lower end block 34B projecting on the lower surface of the outer configuration panel 31.

Figure 20:
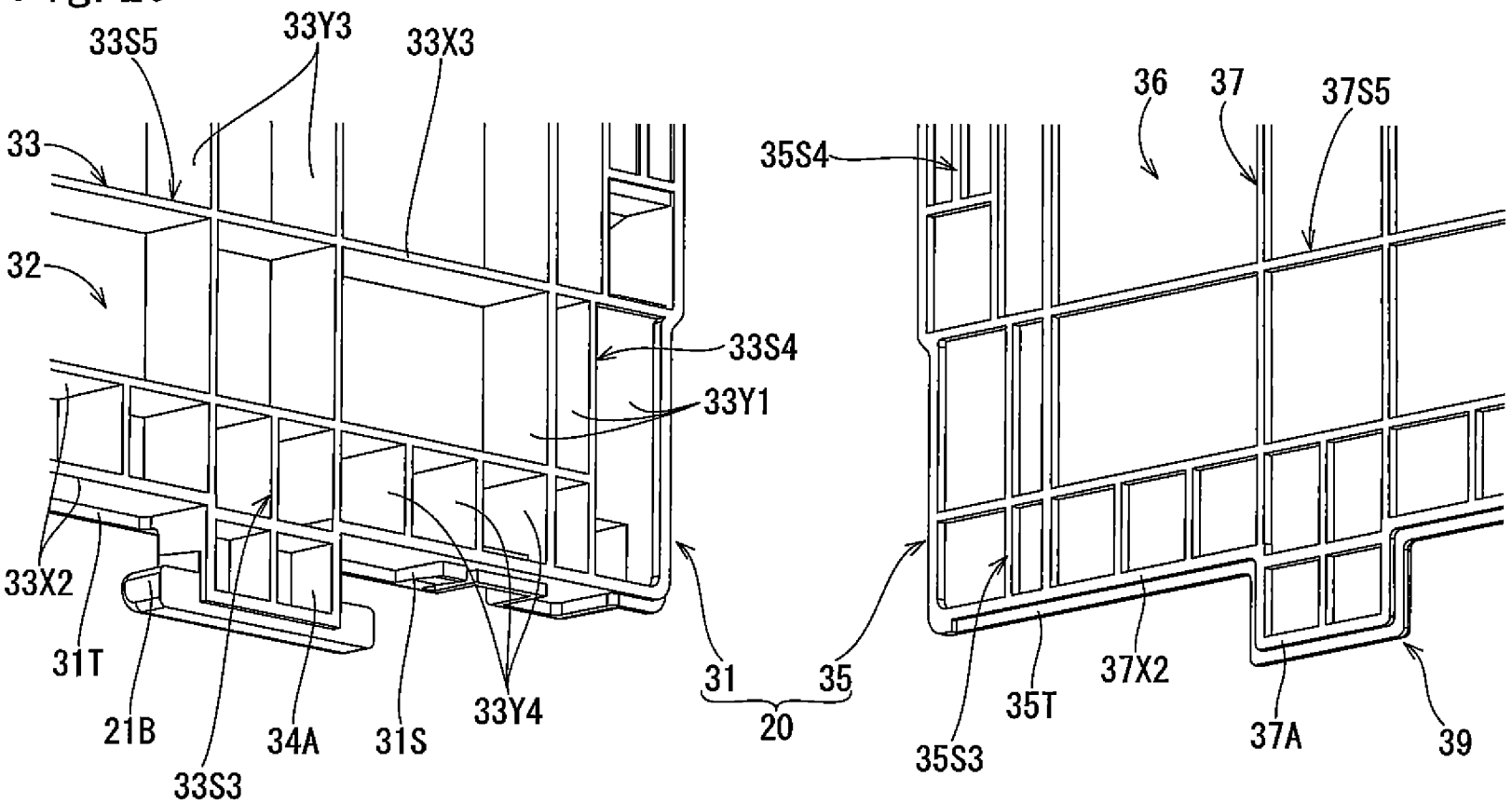
FIG. 20 is a perspective view of an inner surface side of lower end portions of the outer configuration panel and inner configuration panel of the first pallet side wall.

As shown in FIG. 20, on each lower end projection piece 39, a hinge reinforcing rib 37A that is a part of the cell configuration rib 37 is disposed at a position shifted inward from the tip end and side ends. Moreover, a lower edge long transverse rib 37X2 extending in the horizontal direction at a lower end portion in the inner configuration panel 35 is disposed shifted slightly upward from the lower end of the inner main plate 36. And, a part of the inner configuration panel 35 projecting outside further than the hinge reinforcing rib 37A and the lower edge long transverse rib 37X2 serves as a lower end contact projection portion 35T to form lower surface grooves 20M1, 20M2 to be described later.

Moreover, the lower end block 34A for the hinge projection portion 21 is in the same shape as that of the hinge reinforcing rib 37A of the inner configuration panel 35 when viewed from the thickness direction of the outer configuration panel 31, and a lower end surface of the turning shaft portion 21B is located below a lower end surface of the lower end block 34A to form a stepped portion. Moreover, the lower end block 34B for the central projection portion 22, as shown in FIG. 19, has a shape in which both end portions of the turning shaft portion 21B projecting from both side surfaces of the lower end block 34A for the hinge projection portion 21 are cut off, and has a stepped portion at the lower end. Further, on the lower surface of the outer configuration panel 31, a lower end contact projection portion 31T projects from an edge portion distant from the fixed layer 20K, and a plurality of reinforcing protrusions 31S extend from a plurality of positions in the longitudinal direction of the lower end contact projection portion 31T to positions near the fixed layer 20K.

Because of the lower end portion structure of the outer configuration panel 31 and the inner configuration panel 35 mentioned above, in lower end surfaces of the hinge projection portion 21 and the central projection portion 22 in the first pallet side wall 20, as shown in FIG. 19, lower surface grooves 20M1 that are relatively narrow in width are formed, and in the entire lower surface of the first pallet side wall 20, a lower surface groove 20M2 that is relatively wide in width is formed between the lower end contact projection portions 31T, 35T. And, the fixed layer 20K is disposed on a bottom surface of those lower surface grooves 20M1, 20M2. Moreover, on both side surfaces of the hinge projection portion 21 and the central projection portion 22, the lower end contact projection portion 35T is in a state of projecting from the vicinity of the fixed layer 20K.

Here, when the outer configuration panel 31 and the inner configuration panel 35 are heat welded, resin melted in the outer configuration panel 31 and the inner configuration panel 35 can be an excess resin protrusion 20J (refer to FIG. 23) along the outer edge of the fixed layer 20K and project outside from the upper and lower surfaces and both side surfaces of the first pallet side wall 20. And, because the upper surface and both side surfaces of the first pallet side wall 20 are in relatively flat shapes, the excess resin protrusion 20J can be easily cut off by a tool. Since the lower surface of the first pallet side wall 20 is in an irregular shape including the hinge projection portions 21 and the central projection portion 22, the excess resin protrusion 20J cannot be easily cut off by a tool. However, in the box pallet 10 of the present embodiment, because the excess resin protrusion 20J is housed within the lower surface grooves 20M1, 20M2 mentioned above of the lower end portion of the first pallet side wall 20 even without cutting away the excess resin protrusion 20J on the lower surface of the first pallet side wall 20, the excess resin protrusion 20J is prevented from coming into contact with an upper surface of the turn support portion 15A, a floor surface, etc. Accordingly, such a situation can be prevented that the fixed layer 20K cracks due to a stress concentration caused by a load on the excess resin protrusion 20J. Moreover, in the lower surface groove 20M2, a plurality of reinforcing protrusions 31S extend from the lower end contact projection portions 31T to positions near the fixed layer 20K, so that such a situation can also be prevented that, for example, an upper surface corner portion of the turn support portion 15A projects into the inside of the lower surface groove 20M2 and abuts against the excess resin protrusion 20J.

A description has been given above concerning the internal structure relating to the first pallet side wall 20 and the structure of the outer configuration panel 31 and the inner configuration panel 35 that construct the first pallet side wall 20. Next, the internal structure of the second pallet side wall 40 and the structure of the outer configuration panel 61 and the inner configuration panel 65 that construct the second pallet side wall 40 will be described.

Figure 26A:
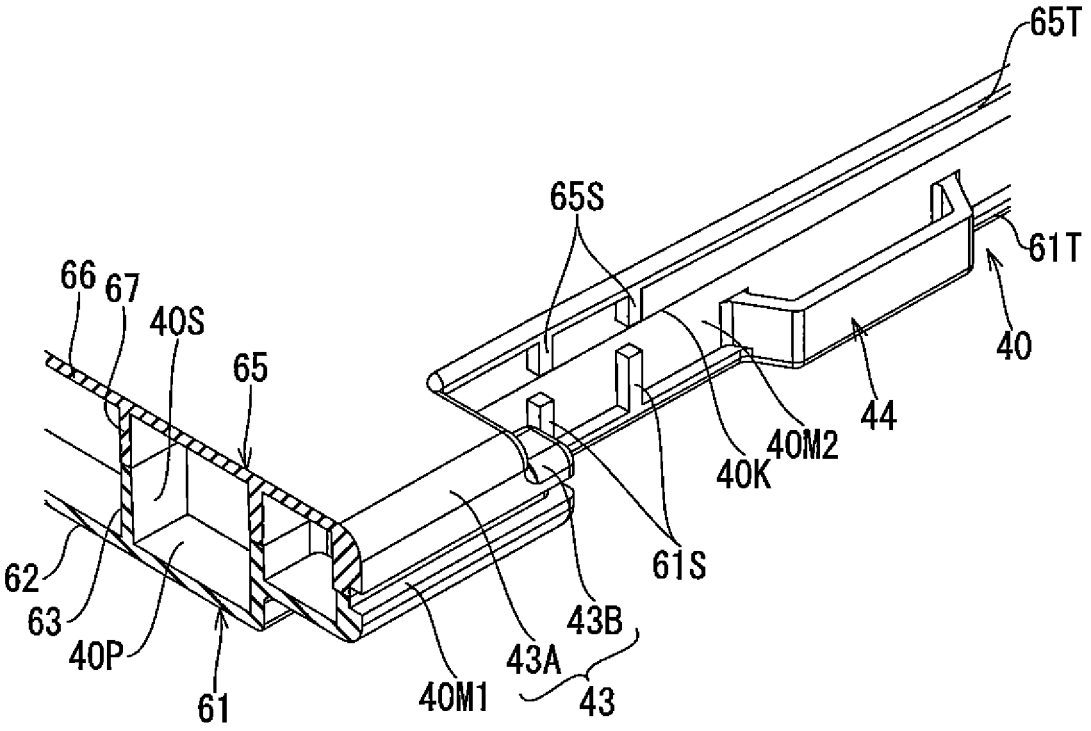
FIG. 26A is a partially broken away perspective view of a lower end portion of a third insertion projection portion.
Figure 26B:
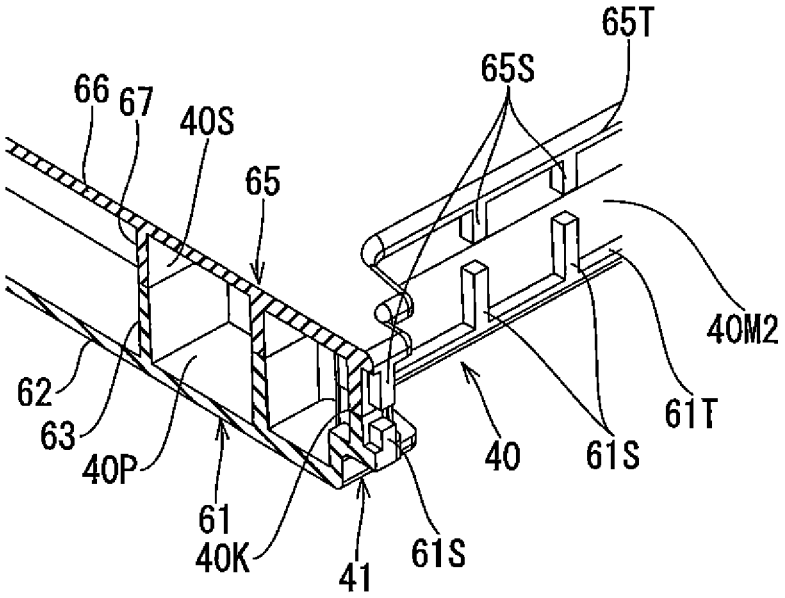
FIG. 26B is a partially broken away perspective view of a lower end portion of a first insertion projection portion.
Figure 27A:
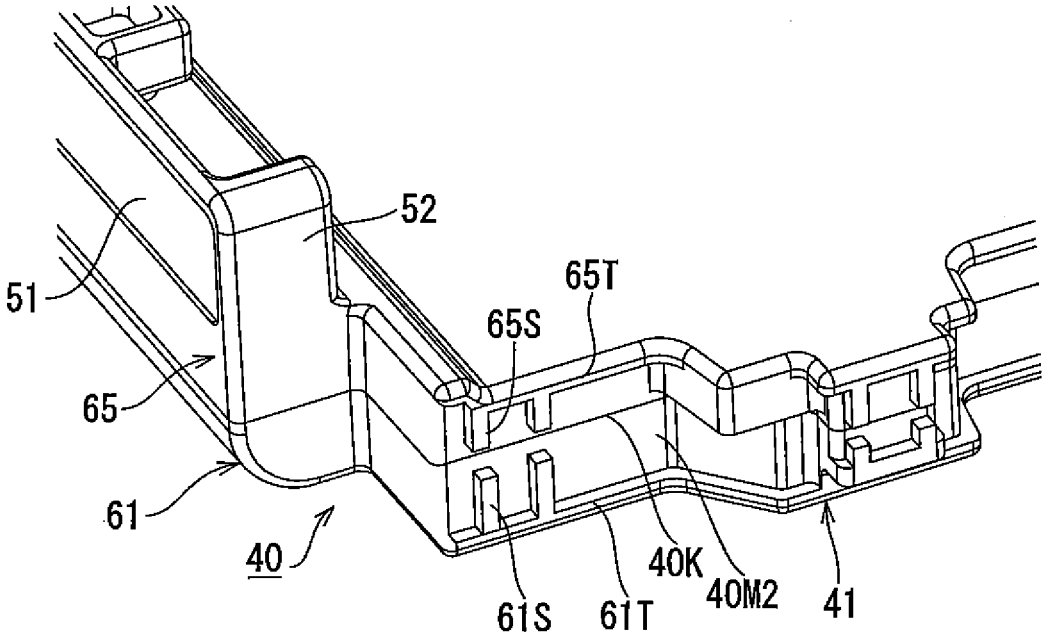
FIG. 27A is a perspective view of a lower end corner portion of the second pallet side wall.
Figure 27B:
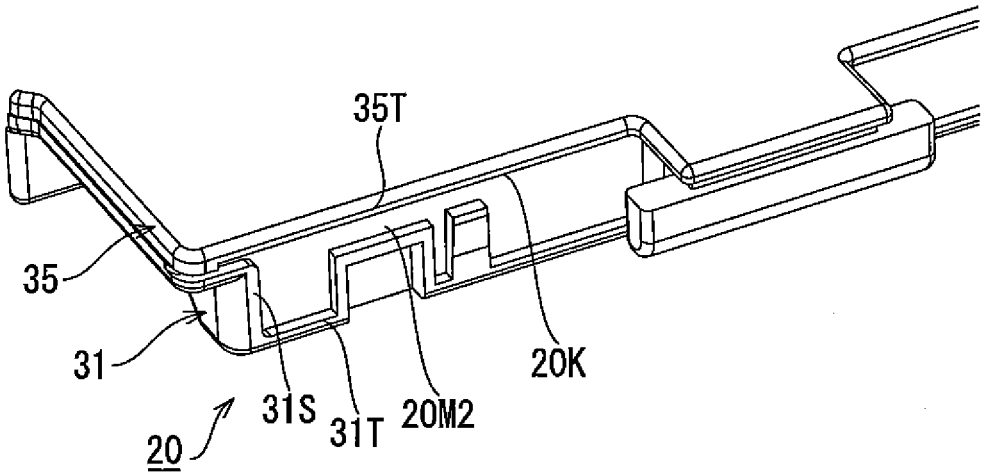
FIG. 27B is a perspective view of a lower end corner portion of the first pallet side wall.

As shown in FIG. 26A and FIG. 26B, the second pallet side wall 40 includes an outer main plate 62 and an inner main plate 66 opposed to each other across an enclosed space 40P. Moreover, between the outer main plate 62 and the inner main plate 66, a resin fixed layer 40K is provided along a plane dividing the entire second pallet side wall 40 into two parts in the thickness direction. Moreover, the fixed layer 40K is disposed at substantially the center in the thickness direction of the second pallet side wall 40. And, the second pallet side wall 40 at one of sides from the fixed layer 40K serves as an outer configuration panel 61 having a structure in which a lattice-like cell configuration rib 63 is laid on the outer main plate 62, while the other side serves as an inner configuration panel 65 having a structure in which a lattice-like cell configuration rib 67 is laid on the inner main plate 66.

Figure 24A:
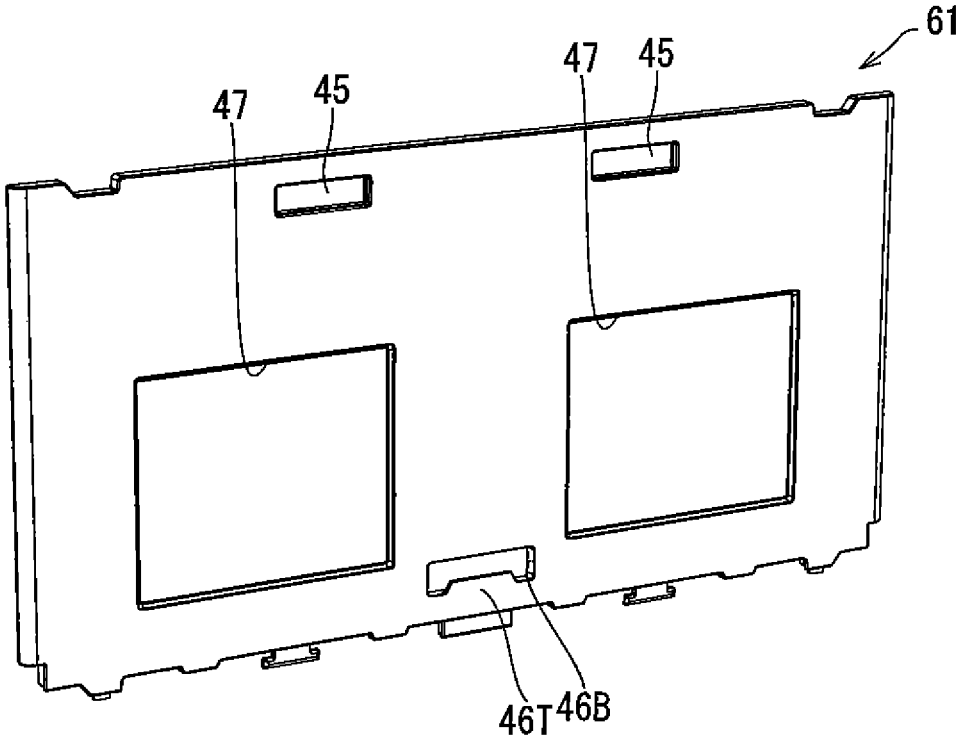
FIG. 24A is a perspective view of an outer surface side of an outer configuration panel of the second pallet side wall.
Figure 24B:
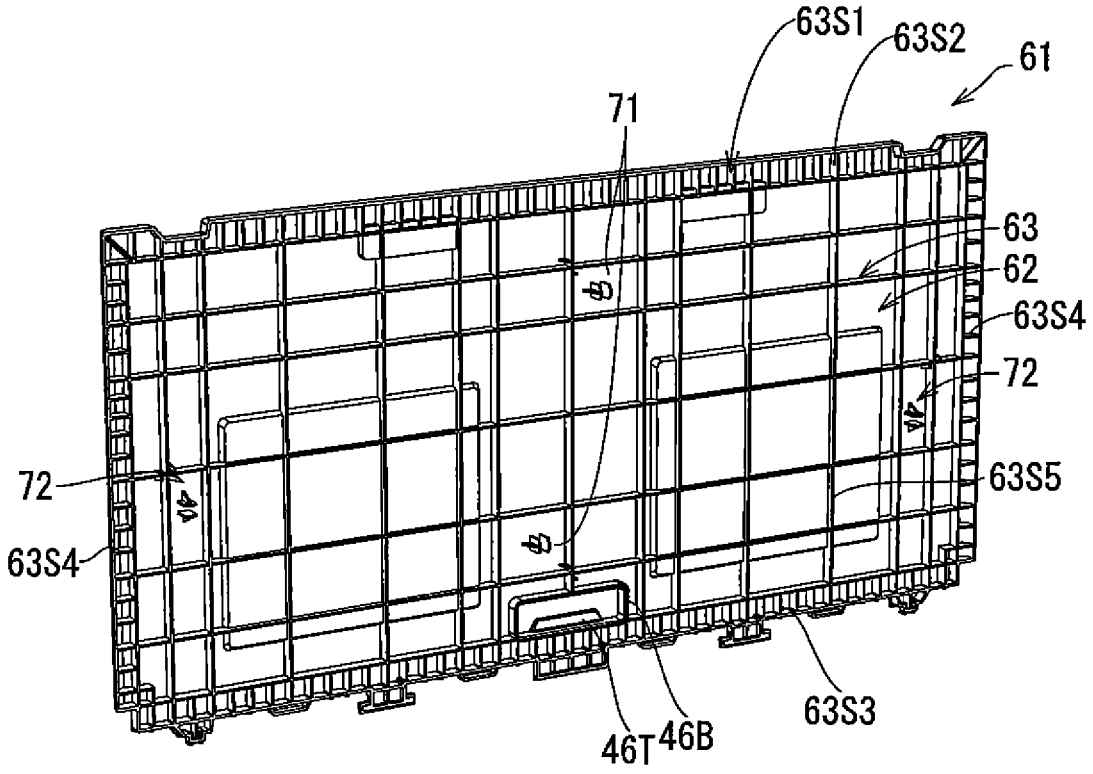
FIG. 24B is a perspective view of an inner surface side of the outer configuration panel of the second pallet side wall.
Figure 25A:
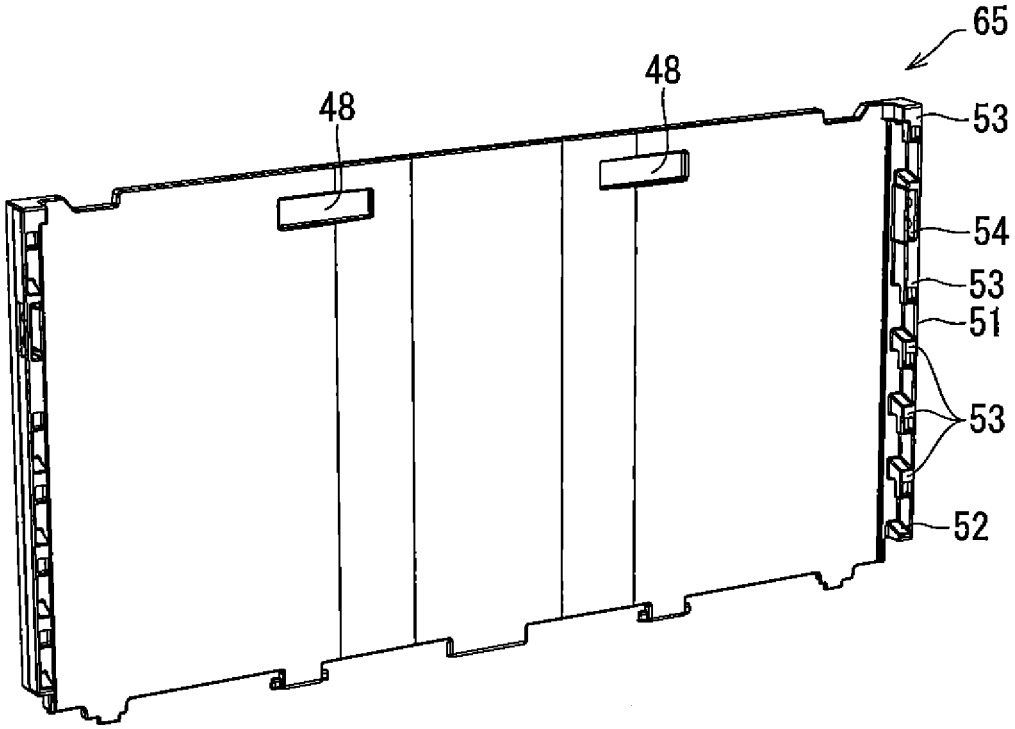
FIG. 25A is a perspective view of an outer surface side of an inner configuration panel of the second pallet side wall.
Figure 25B:
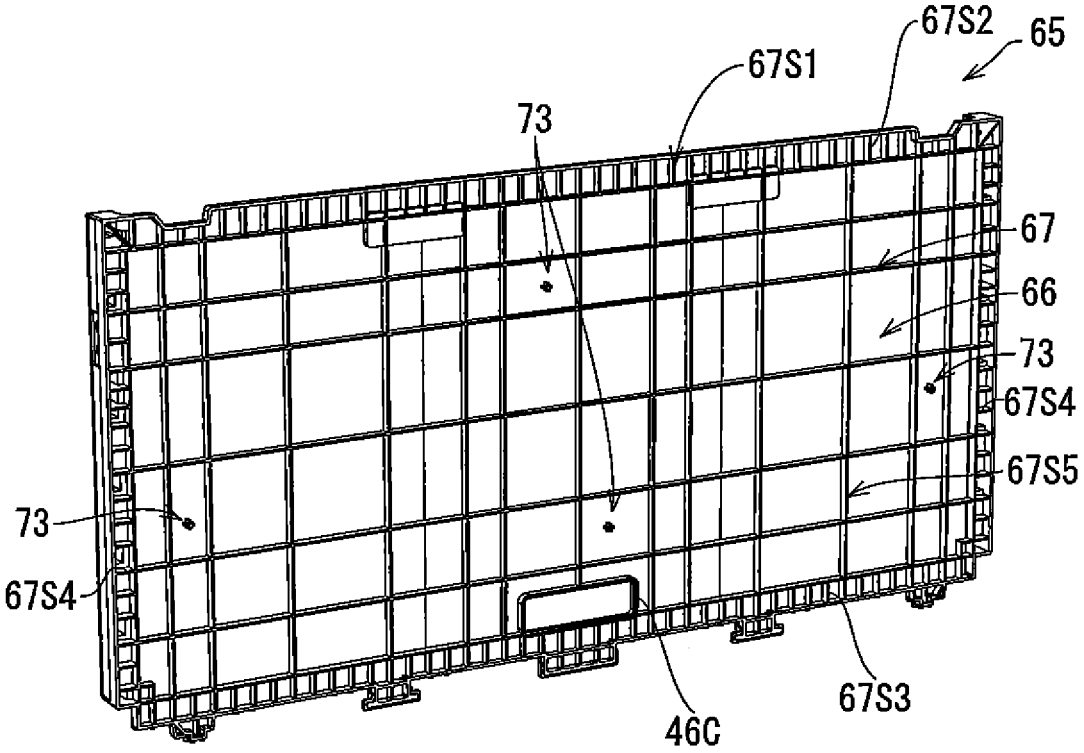
FIG. 25B is a perspective view of an inner surface side of the inner configuration panel of the second pallet side wall.

Similar to the first pallet side wall 20, also in the second pallet side wall 40, frame-like region cells 63S1, 67S1 in frame-like regions along the outer edges of the outer configuration panel 61 and the inner configuration panel 65 have meshes finer than those of central region cells 63S5, 67S5 in central regions inside the frame-like regions (refer to FIG. 24B and FIG. 25B). And, tip end portions of the cell configuration ribs 63, 67 are firmly fixed to each other by heat welding, and the outer main plate 62 and the inner main plate 66 are joined by those cell configuration ribs 63, 67, and the enclosed space 40P is demarcated into a plurality of cells (small rooms) 40S (refer to FIG. 26A and FIG. 26B). Moreover, transverse positioning portions 71, longitudinal positioning portions 72, and positioning fitting projection portions 73 (refer to FIG. 24B and FIG. 25B) for positioning when performing the heat welding are provided on opposing surfaces of the outer main plate 62 and the inner main plate 66.

Also, similar to the handhold portion 23 of the first pallet side wall 20, an outer-surface lower end handhold portion 46 of the second pallet side wall 40 is divided into a rectangular cylinder 46B of the outer configuration panel 61 shown in FIG. 24B and an annular rib 46C of the inner configuration panel 65 shown in FIG. 25B. Moreover, outer-surface upper end handhold recess portions 45 are disposed in their entirety on the outer configuration panel 61 as shown in FIG. 24A, and are formed by depressing the outer main plate 62, and inner-surface upper end handhold recess portions 48 are, as shown in FIG. 25A, disposed in their entirety on the inner configuration panel 65, and are formed by depressing the inner main plate 66. Moreover, the side cover wall 51, the side portion lower end wall 52, the downward engaging hooks 53, and the engaging recess portion 54 are also disposed in their entirety on the inner configuration panel 65 side.

As shown in FIG. 14, the fourth insertion projection portions 44 out of the first to fourth insertion projection portions 41, 42, 43, 44 mentioned above on the lower surface of the second pallet side wall 40 are disposed in their entirety on the outer configuration panel 61, and the remaining first to third insertion projection portions 41, 42, 43 are divided into two parts each by the fixed layer 40K, and in the third insertion projection portion 43, the base portion 43A and the latch projection portion 43B are both divided into two parts each. Moreover, similar to the lower end contact projection portion 31T and the reinforcing protrusions 31S of the outer configuration panel 31 mentioned above, as shown in FIG. 26A, on a lower surface of the outer configuration panel 61, a lower end contact projection portion 61T and reinforcing protrusions 61S are formed in a projecting manner, and on a lower surface of the inner configuration panel 65, a lower end contact projection portion 65T and reinforcing protrusions 65S are formed in a projecting manner. Further, the lower end contact projection portions 61T, 65T and the reinforcing protrusions 61S, 65S are also extended to component parts of the first insertion projection portions 41 in the outer configuration panel 61 and the inner configuration panel 65. Accordingly, as shown in FIG. 26B, similar to the lower surface grooves 20M2 of the first pallet side wall 20, in the lower surface of the second pallet side wall 40 and lower end surfaces and side surfaces of the first insertion projection portions 41, a lower surface groove 40M2 that is relatively wide in width is formed, and the fixed layer 40K is disposed on its bottom surface.

Moreover, as shown in FIG. 14, similar to the lower surface groove 20M1 of the first pallet side wall 20 mentioned above, in the second and third insertion projection portions 42, 43, a lower surface groove 40M1 that is relatively narrow in width is formed over the whole of each extending from the tip end to both side surfaces, and the fixed layer 40K is disposed on bottom surfaces of those lower surface grooves 40M1. Accordingly, similar to the first pallet side wall 20, even when an excess resin protrusion remains on the lower surface of the second pallet side wall 40, load on the excess resin protrusion can be prevented.

Also, some of the plurality of reinforcing protrusions 61S, 65S mentioned above are disposed on both end portions in the longitudinal direction in the lower surface of the second pallet side wall 40 (refer to FIG. 27A), and protect lower end corner portions of the second pallet side wall 40 that are particularly likely to receive impact. Moreover, similar to the above, some of the plurality of reinforcing protrusions 31S are also disposed on both end portions in the longitudinal direction in the lower surface of the first pallet side wall 20 (refer to FIG. 27B).

In the box pallet 10 of the present embodiment, although not shown, the outer configuration panel 31 and the inner configuration panel 35 in the first pallet side wall 20 have different colors from each other, and the outer configuration panel 61 and the inner configuration panel 65 in the second pallet side wall 40 are different in colors from each other. In addition thereto, the outer configuration panel 31 of the first pallet side wall 20 and the outer configuration panel 61 of the second pallet side wall 40 have same type of colors (for example, blue colors), and the inner configuration panel 35 of the first pallet side wall 20 and the inner configuration panel 65 of the second pallet side wall 40 are the same in color (for example, white). Also, the outer configuration panels 31, 61 correspond to the "outer part" of the present invention, and the inner configuration panels 35, 65 correspond to the "inner part" of the present invention.

Figure 28:
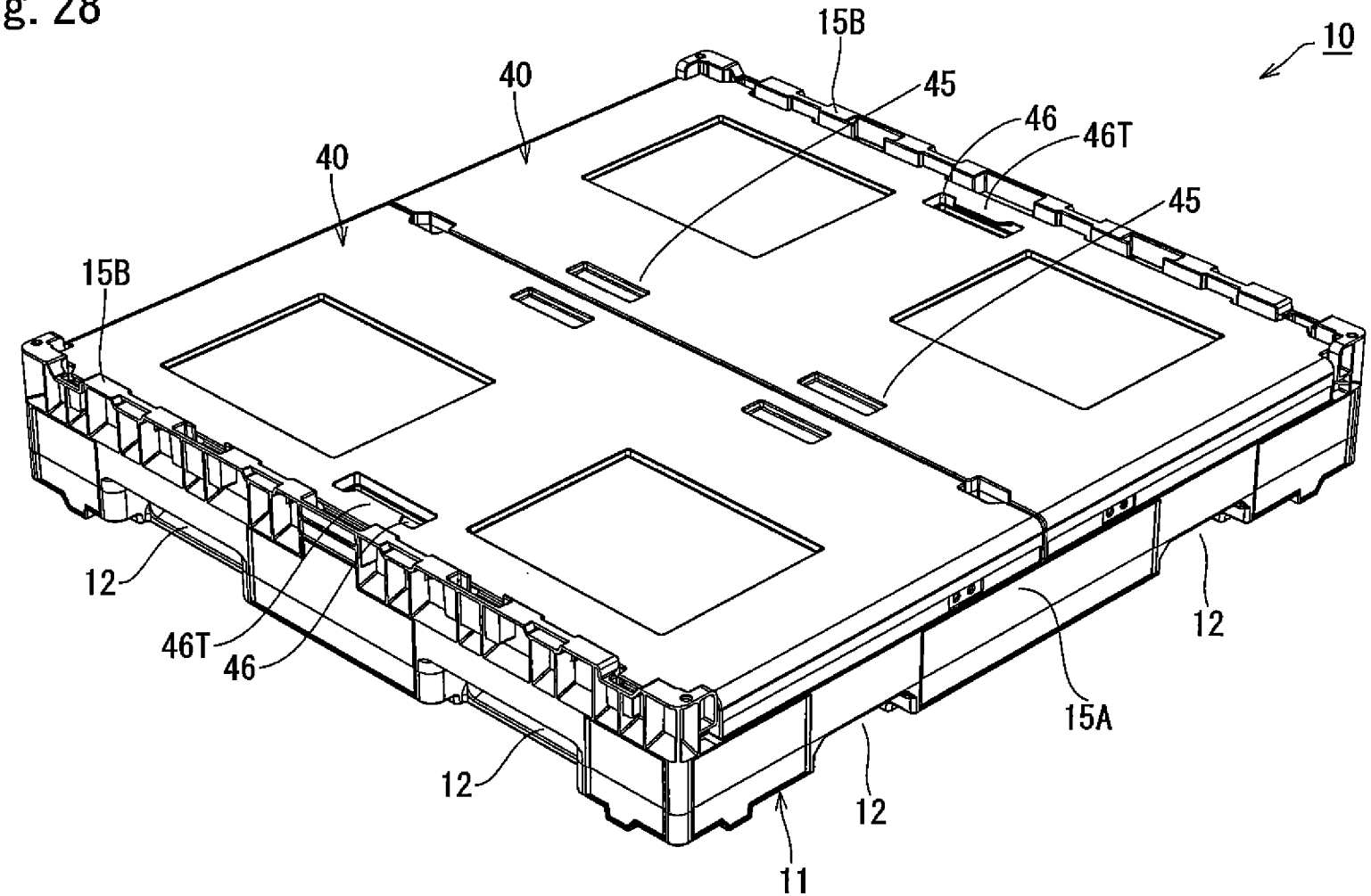
FIG. 28 is a perspective view of the box pallet in a folded-down state.

The description has been given above concerning the structure of the box pallet 10 of the present embodiment. Next, operation and effects of this box pallet 10 will be described. The box pallet 10 can be folded down, when not in use, into a state of the first pallet side walls 20, 20 and the second pallet side walls 40, 40 being laid on the pallet main body 11 as shown in FIG. 28. Specifically, for the box pallet 10 in an assembled state shown in FIG. 1, the respective coupling sliders 27 are slid to release engagement with the engaging recess portions 54 (refer to FIG. 8), and then the pair of first pallet side walls 20, 20 are turned in sequence to be folded and overlaid on the pallet main body 11 as shown in FIG. 30. Here, the respective upward engaging hooks 26C of the first pallet side wall 20 can be detached by moving laterally to a side opposite to the side cover wall 51 with respect to the respective downward engaging hooks 53 of the second pallet side wall 40 with which those upward engaging hooks 26C are engaged, so that the first pallet side walls 20, 20 can be folded down on the pallet main body 11 even without removing the second pallet side walls 40, 40.

Subsequently, one second pallet side wall 40 is removed upward from the pallet main body 11. At this time, by hooking and pulling up, with the fingers of both hands, the pair of outer surface upper end handhold recess portions 45, of the second pallet side wall 40 and the pair of inner-surface upper end handhold recess portions 48, 48 disposed on the back side of the hand recess portions 45, 45, the second pallet side wall 40 can be easily removed from the pallet main body 11.

Then, the second pallet side wall 40 is removed and then turned into a substantially horizontal position, and a tip end portion (an upper end portion of the second pallet side wall 40 in an erected position) is brought into contact on the first pallet side wall 20, and also a base end portion (a lower end portion of the second pallet side wall 40 in the erected position) of the second pallet side wall 40 is pulled up upper than the tip end portion, and the latch projection portion 43B of the third insertion projection portion 43 is inserted from above into the third receiving recess portion 17C of the pallet main body 11 (refer to FIG. 14). At this time, by hooking fingers over the projection piece 46T of the outer surface lower end handhold portion 46 in each second pallet side wall 40, the latch projection portion 43B can be easily inserted from above into the third receiving recess portion 17C. Then, when the same operation is performed also for the other second pallet side wall 40, it reaches a state, as shown in FIG. 28, where the pair of second pallet side walls 40, 40 are fitted side by side between the pair of insertion support portions 15B, 15B, and accordingly, the folding-down operation of the box pallet 10 is completed.

For bringing the box pallet 10 in a folded-down state into an assembled state, in a manner reverse to the operation mentioned above, first, the second pallet side walls 40, 40 are taken out from between the pair of insertion support portions 15B, 15B, and attached in the erected position onto the insertion support portions 15B, 15B. Then, it suffices to turn the first pallet side walls 20, 20 up to the erected position, and engage the respective coupling sliders 27 with the engaging recess portions 54. At that time of assembling operation, the second pallet side walls 40 can be easily taken out from between the pair of insertion support portions 15B, 15B by hooking fingers over the projection pieces 46T of the outer surface lower end handhold portions 46 in the second pallet side walls 40, and the first pallet side walls 20 can be easily turned up to the erected position by hooking fingers over the projection pieces 23T of the handhold portions 23 in the first pallet side walls 20.

Alternatively, the box pallet 10 may be assembled by the following procedure. That is, the procedure may include taking out the second pallet side walls 40, 40 from between the insertion support portions 15B, 15B, leaving the second pallet side walls 40, 40 to lean against places different from positions on the insertion support portions 15B (for example, floor surface etc.), and after turning the first pallet side walls 20, 20 up to the erected position, attaching in the erected position onto the insertion support portions 15B in sequence the pair of second pallet side walls 40, 40 that had been left to lean on. Here, because the second pallet side walls 40 have two colors differentiated in the thickness direction, the front and back sides of the second pallet side wall 40 can be easily distinguished when attaching the second pallet side wall 40 to the insertion support portion 15B. Moreover, because the outer configuration panel 31 of the first pallet side wall 20 and the outer configuration panel 61 of the second pallet side wall 40 have same type of colors (for example, blue colors), the front and back sides of the second pallet side wall 40 can also be easily distinguished by matching the colors of the outer surfaces of the first pallet side wall 20 and the second pallet side wall 40 to each other, so that the second pallet side wall 40 can be placed on the insertion support portion 15B without mixing up the front and back sides.

Figure 7:
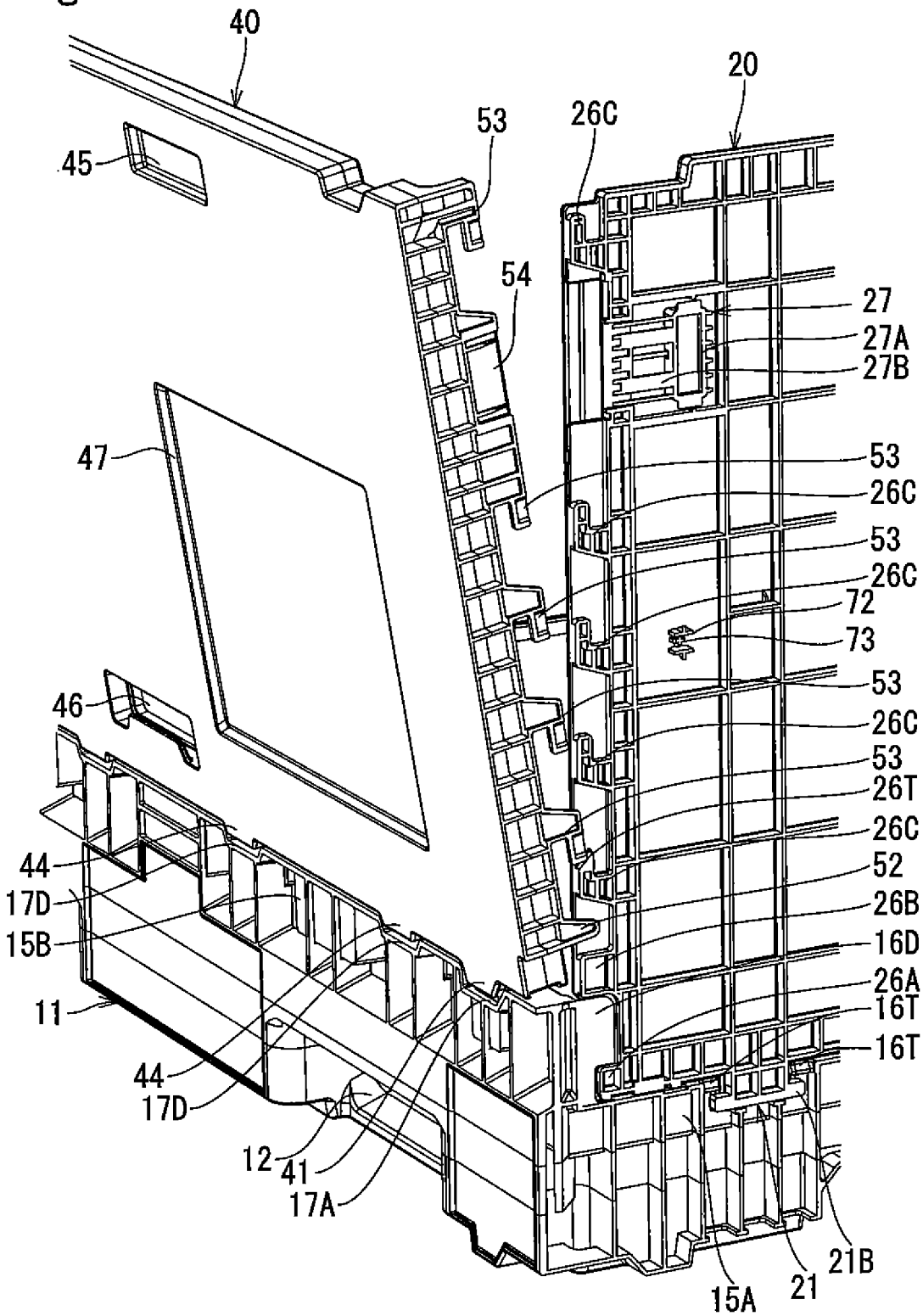
FIG. 7 is a perspective view of a state where the second pallet side wall is butted against an upper surface of the insertion support portion.

Moreover, for attaching in the erected position the second pallet side wall 40 onto the insertion support portion 15B, for example, as shown in FIG. 7, it suffices to place the second pallet side wall 40 in an obliquely raised state on the insertion support portion 15B, and then turn the same until reaching the erected position. Then, the downward engaging hook 53 in the lowermost end portion makes sliding contact with the guiding tapered surface 26T of the upward engaging hook 26C in the lowermost end portion in the middle of the turn, and the respective downward engaging hooks 53 move above the corresponding respective upward engaging hooks 26C. By moving the second side wall 40 downward in that state, as shown in FIG. 8, the respective downward engaging hooks 53 and the respective upward engaging hooks 26C are engaged with each other. It suffices to then engage the coupling slider 27 (refer to FIG. 9A) with the engaging recess portion 54 (refer to FIG. 16).

Also, with regard also to the procedure for folding down the box pallet 10, separate from the foregoing procedure, for example, a procedure may be adopted to remove the second pallet side walls 40, 40 from the pallet main body 11 before folding down the first pallet side walls 20, 20, and to fold down the first pallet side walls 20, 20 and then to lay the second pallet side walls 40, 40 thereon.

When a content is stored in the box pallet 10 in the assembled state, the first pallet side walls 20 and the second pallet side walls 40 receive a load (a moment) in such a manner as to bulge outward due to a pressure of the content. However, the first pallet side wall 20 and the second pallet side wall 40 corresponding to the "box pallet side wall" of the present invention have hollow structures, and include the outer main plate 32 and the inner main plate 36 opposed to each other and the outer main plate 62 and the inner main plate 66, so that compared to a conventional box pallet side wall having a solid structure, when the box pallet side wall and the conventional one have the same weight, the geometrical moment of inertia of the box pallet side wall is increased and the strength thereof is higher. Therefore, according to the box pallet 10 of the present embodiment, a content heavier than a conventional one can be transported. Additionally, when the box pallet side wall and the conventional one have the same strength, the box pallet side wall is lighter in weight than the conventional one, and the box pallet 10 is easily transported. In addition, because the interiors of the first pallet side wall 20 and the second pallet side wall 40 are enclosed spaces 20P, 40P, the first pallet side wall 20 and the second pallet side wall 40 also never become heavier in weight due to entry of water. Further, because the outer main plate 32 and the inner main plate 36 and the outer main plate 62 and the inner main plate 66 are reinforced by the cell configuration ribs 33, 37, 63, 67 that demarcate the enclosed spaces 20P, 40P into each plurality of cells 20S, 40S, high strengthening and weight saving become possible also in this point compared to the conventional one. Furthermore, since those cell configuration ribs 33, 37, 63, 67 are housed in the first pallet side wall 20 and the second pallet side wall 40 and not exposed on the outside, irregularity on the outer surfaces of the first pallet side wall 20 and the second pallet side wall 40 can be decreased compared to the conventional one, and thus cleaning is easily performed, and the appearance is improved.

Meanwhile, as shown in FIG. 29, when a plurality of box pallets 10 are stacked up and a forklift fork is inserted into the upper box pallet 10, erroneous abutting of the fork against an upper edge region of the first pallet side wall 20 or the second pallet side wall 40 in the lower box pallet 10 can occur. Moreover, as shown in FIG. 28, in a folded-down state of the upper box pallet 10, abutting of the fork against a side edge region of the second pallet side wall 40 of the box pallet 10 can also occur.

However, in the present embodiment, as a result of the frame-like region cells 33S1, 37S1, 63S1, 67S1 disposed in the frame-like regions of the outer edges of the first pallet side walls 20 and the second pallet side wall 40 being demarcated more finely than the central region cells 33S5, 37S5, 63S5, 67S5 disposed in the central regions, the frame-like regions are reinforced, so that damage and deformation of the first pallet side walls 20 and the second pallet side walls 40 due to abutting of the fork are prevented. Moreover, as compared to one in that the cells are made fine in the whole of the first pallet side walls 20 and the second pallet side walls 40 to achieve reinforcement, an increase in weight of the first pallet side walls 20 and the second pallet side walls 40 can be suppressed.

Other Embodiments

The present invention is not limited to the above-mentioned embodiment, and for example, such embodiments as to be described in the following are also included in the technical scope of the present invention, and further, the present invention can be carried out by various modifications within the scope not deviating from the gist thereof other than the following.

(1) In the above-mentioned embodiment, the cell configuration ribs (33, 37, 63, 67) are provided on both of the outer configuration panel (31, 61) and the inner configuration panel (35, 65), but a cell configuration rib may be provided on only one of the outer configuration panel and the inner configuration panel, and the other may have a flat-plate structure having no rib.

(2) In the above-described embodiment, adopted is the configuration in which one box pallet side wall (first pallet side wall 20) is turnably joined to the pallet main body and the other box pallet side wall (second pallet side wall 40) is inserted into the pallet main body, but configurations may be adopted that all of the four box pallet side walls are turnably joined to the pallet main body, or all of the four box pallet side walls are inserted into the pallet main body to be joined.

(3) In above-mentioned embodiment, the frame-like region cells 33S1, 37S1, 63S1, 67S1 in the entire frame-like regions of the outer edges in the first pallet side wall 20 and the second pallet side wall 40 are demarcated more finely than the central region cells 33S1, 37S1, 63S1, 67S1 disposed in the central regions, but only the upper edge region cells 33S2, 37S2, 63S2, 67S2 in the upper edge regions corresponding to upper side portions of the frame-like regions may be demarcated more finely than the central region cells 33S1, 37S1, 63S1, 67S1 in the central regions, or only the side edge region cells 33S4, 37S4, 63S4, 67S4 in the side edge regions corresponding to both lateral side portions of the frame-like regions may be demarcated more finely than the central region cells 33S1, 37S1, 63S1, 67S1 in the central regions.

DESCRIPTION OF REFERENCE NUMERALS

10 Box pallet
11 Pallet main body
12 Fork insertion hole
20 First pallet side wall (box pallet side wall)
20J Excess resin protrusion
20K, 40K Fixed layer
20M1, 20M2, 40M1, 40M2 Lower surface groove
20P, 40P Enclosed space
31S, 61S, 65S Reinforcing protrusion
32, 62 Outer main plate
33, 37, 63, 67 Cell configuration rib
33S1, 37S1, 63S1, 67S1 Frame-like region cell
33S2, 37S2, 63S2, 67S2 Upper edge region cell
33S4, 37S4, 63S4, 67S4 Side edge region cell
33S5, 37S5, 63S5, 67S5 Central region cell
36, 66 Inner main plate
40 Second pallet side wall (box pallet side wall)

The invention claimed is:

1. A box pallet side wall which is assembled in plural numbers on an upper surface edge portion of a pallet main body, and constructs together with the pallet main body a box pallet with a box-shaped structure opened at an upper surface, comprising:

an outer main plate and an inner main plate forming a hollow structure having an enclosed space therein, and being opposed in a thickness direction of the box pallet side wall across the enclosed space;

a cell configuration rib for joining the outer main plate and the inner main plate, and demarcating the enclosed space into a plurality of cells;

a fixed layer disposed at a position dividing the entire box pallet side wall into two parts in the thickness direction, and formed by firmly fixing resins constructing the box pallet side wall to each other; and a lower surface groove formed in a lower surface of the box pallet side wall, having a groove shape extending along the fixed layer, and having the fixed layer at a bottom surface of the groove shape.

2. The box pallet side wall according to claim 1, comprising:

a plurality of central region cells included in the plurality of cells, and disposed in a central region that is inner than an outer edge portion of the box pallet side wall; and a plurality of upper edge region cells included in the plurality of cells, disposed in an upper edge region along an upper outer edge portion in the box pallet side wall, and demarcated more finely than the plurality of central region cells.

3. The box pallet side wall according to claim 1, comprising:

a plurality of central region cells included in the plurality of cells, and disposed in a central region that is inner than an outer edge portion of the box pallet side wall; and a plurality of side edge region cells included in the plurality of cells, disposed in a side edge region along an outer edge portion at both left and right sides in the box pallet side wall, and demarcated more finely than the plurality of central region cells.

4. The box pallet side wall according to claim 2, comprising:

a plurality of side edge region cells included in the plurality of cells, disposed in a side edge region along an outer edge portion at both left and right sides in the box pallet side wall, and demarcated more finely than the plurality of central region cells.

5. The box pallet side wall according to claim 1, comprising:

a plurality of central region cells included in the plurality of cells, and disposed in a central region that is inner than an outer edge portion of the box pallet side wall; and a plurality of frame-like region cells included in the plurality of cells, disposed in a frame-like region of an entire outer edge portion of the box pallet side wall, and demarcated more finely than the plurality of central region cells.

6. The box pallet side wall according to claim 1, comprising a reinforcing protrusion formed at the bottom surface of the lower surface groove, and extending from a groove inner side surface of the lower surface groove to a position approximating the fixed layer.

7. The box pallet side wall according to claim 2, comprising a reinforcing protrusion formed at the bottom surface of the lower surface groove, and extending from a groove inner side surface of the lower surface groove to a position approximating the fixed layer.

8. The box pallet side wall according to claim 3, comprising a reinforcing protrusion formed at the bottom surface of the lower surface groove, and extending from a groove inner side surface of the lower surface groove to a position approximating the fixed layer.

9. The box pallet side wall according to claim 5, comprising a reinforcing protrusion formed at the bottom surface of the lower surface groove, and extending from a groove inner side surface of the lower surface groove to a position approximating the fixed layer.

10. The box pallet side wall according to claim 2, wherein outer parts of the fixed layer, along the thickness direction, are differentiated in color from the inner parts of the fixed layer, along the thickness direction.

11. The box pallet side wall according to claim 3, wherein outer parts of the fixed layer, along the thickness direction, are differentiated in color from inner parts of the fixed layer, along the thickness direction.

12. The box pallet side wall according to claim 5, wherein outer parts of the fixed layer, along the thickness direction, are differentiated in color from inner parts of the fixed layer, along the thickness direction.

13. The box pallet side wall according to claim 4, wherein outer parts of the fixed layer, along the thickness direction, are differentiated in color from inner parts of the fixed layer, along the thickness direction.

14. The box pallet side wall according to claim 10, wherein among a plurality of the box pallet side walls to be assembled on the pallet main body in common, colors of parts outer than the fixed layer are same colors or same type of colors, or colors of parts inner than the fixed layer are same colors or same type of colors.

15. A box pallet side wall which is assembled in plural numbers on an upper surface edge portion of a pallet main body, and constructs together with the pallet main body a box pallet with a box-shaped structure opened at an upper surface, comprising:

an outer main plate and an inner main plate forming a hollow structure having an enclosed space therein, and being opposed in a thickness direction of the box pallet side wall across the enclosed space;

a cell configuration rib for joining the outer main plate and the inner main plate, and demarcating the enclosed space into a plurality of cells; and a fixed layer disposed at a position dividing the entire box pallet side wall into two parts in the thickness direction, and formed b firmly fixing resins constructing the box pallet side wall to each other, wherein outer parts of the fixed layer, along the thickness direction, are differentiated in color from inner parts of the fixed layer, along the thickness direction.

16. The box pallet side wall according to claim 15, wherein among a plurality of the box pallet side walls to be assembled on the pallet main body in common, colors of parts outer than the fixed layer are same colors or same type of colors, or colors of parts inner than the fixed layer are same colors or same type of colors.

* * * * *